US008542109B2

(12) United States Patent
Butler et al.

(10) Patent No.: US 8,542,109 B2
(45) Date of Patent: Sep. 24, 2013

(54) FOLIAGE PENETRATING SENSOR ARRAY FOR INTRUSION DETECTION

(75) Inventors: Walker Butler, Scottsdale, AZ (US); John Edward Bjornholt, Fountain Hills, AZ (US)

(73) Assignee: Flir Systems, Inc., Wilsonville, OR (US)

( * ) Notice: Subject to any disclaimer, the term of this patent is extended or adjusted under 35 U.S.C. 154(b) by 325 days.

(21) Appl. No.: 12/220,831

(22) Filed: Jul. 29, 2008

(65) Prior Publication Data

US 2010/0026490 A1 Feb. 4, 2010

(51) Int. Cl.
*G08B 13/18* (2006.01)

(52) U.S. Cl.
USPC ..... 340/522; 340/552; 340/555; 340/556; 340/557; 342/27; 342/28

(58) Field of Classification Search
USPC ..... 340/552, 555, 556, 557; 342/27, 342/28
See application file for complete search history.

(56) References Cited

U.S. PATENT DOCUMENTS

| | | | | |
|---|---|---|---|---|
| 5,376,922 | A * | 12/1994 | Kiss | 340/552 |
| 6,424,259 | B1 * | 7/2002 | Gagnon | 340/554 |
| 2005/0078006 | A1 * | 4/2005 | Hutchins et al. | 340/561 |
| 2008/0165046 | A1 * | 7/2008 | Fullerton et al. | 342/21 |

* cited by examiner

*Primary Examiner* — Tai T Nguyen
*Assistant Examiner* — Ojiako Nwugo
(74) *Attorney, Agent, or Firm* — McAfee & Taft

(57) ABSTRACT

An intrusion detection system that provides foliage penetration is disclosed employing an array of field disturbance transceivers operating at UHF frequencies. The array of transceivers generate a multiplicity of electromagnetic wave fields between nearby units and detect the presence of intruders by detecting disturbances in these fields. The emitted UHF signals used to generate the electromagnetic wave fields are also used to provide the communication link between transceivers in the array and to a control station. The control station facilitates the operation of the array from a remote monitoring site. A unique method of array deployment provides multiple opportunities to detect an intruder and secondarily provides redundant communication links in case of a sensor failure. Automatic means of setting detection thresholds based on environmental conditions assures a high probability of detection along with a low false alarm rate.

16 Claims, 13 Drawing Sheets

FOLIAGE PENETRATING SENSOR ARRAY FOR INTRUSION DETECTION

FIELD OF THE INVENTION

The present invention relates generally to the field of intrusion detection in the presence of foliage and irregular terrain, and in particular to intrusion detection by electromagnetic field disturbance.

BACKGROUND OF THE INVENTION

A significant need exists to detect personnel and vehicles that cross boundaries into forbidden areas. These boundaries may be the borders of a state or nation, or the perimeter around a facility. Nations have a need to detect attempts to cross their borders by agents of hostile nations or terrorist organizations, and by those who seek the economic or political benefit of residency without going through the lawful immigration process. Many facilities, with examples being airports, nuclear power plants, military bases, and penal institutions, are contained within perimeters that must be monitored to assure that no individual enters or leaves the facility without proper authorization. Timely detection of intruders will enable their interdiction by the forces charged with protecting the boundary.

Many territorial borders and facility perimeters run across irregular terrain that may include variations in elevation; drainage conduits typically referred to as washes or arroyos; boulders and rock formations; and foliage of various types. An effective intrusion detection system must include means to detect the passage of intruders who attempt to take advantage of these terrain features in their attempt to avoid detection.

Numerous intrusion detection systems have been developed that depend upon the generation of narrow beams directed parallel to the boundary to be protected. The passage of an intruder is typically detected by one of several means: by the interruption of one or more beams proceeding between a source and a receiver, by the reflection of transmitted energy in the beam back to a receiver collocated with the transmitter, or by detecting the infrared emissions from the person of the intruder. These intrusion detection systems typically depend upon the use of microwave, millimeter wave or infrared techniques that allow small, narrow beamwidth antennas or lens systems for practical deployment along a boundary.

A common problem with the beam breaker, radar, or infrared sensor intrusion detection systems is that they require an unobstructed line-of-sight between the sensor and the intruder for reliable operation. If uneven terrain, washes and foliage exist at numerous locations along the perimeter to be protected, these types of intrusion detection systems frequently fail to detect intruders.

An example of prior art that employs microwave beam interruption to achieve intruder detection and having some similarity to the present invention is disclosed by Kiss, U.S. Pat. No. 5,376,922, issued on Dec. 27, 1994. Two separately located microwave transmitter modules with directional microwave antennas, a sector module that includes two microwave receivers coupled to directional antennas that are deployed to receive maximum microwave energy from the two diversely located transmitter modules, and a remotely located central station comprise the basic elements of this intrusion detection system. The central station commands the transmitter modules to generate short coded emissions, the sector module receivers receive these signals, evaluate their characteristics, and determine if an intrusion has occurred based on a sufficiently large change in signal level. The central station is coupled to each of the transmitter modules and to each of the sector modules via UHF communication link to control operation of the modules, receive status information and detection data. Multiple transmitter modules and sector modules are deployed to form an intrusion detection barrier along a boundary. A single central station communicates with, and controls the operation of, the multiplicity of modules via a complex, multiple channel UHF system.

Another example of prior art that provides for the detection of intruders is disclosed by Gagnon, U.S. Pat. No. 6,424,259 B1, Jul. 23, 2002. This invention deploys a series of small patch antennas mounted at intervals along the vertical surface of a security fence or other similar structure. Spaced at a constant distance from the multiple patch antennas is a leaky coaxial cable installed along the surface of the ground. Microwave energy leaking from the cable develops an electromagnetic field in the area between the coax and the multiple antennas; alternately, emissions from the antennas are collected by the coaxial cable to form the electromagnetic field. Multiple switches are used to couple specific antennas and sections of the coaxial cable to a transmitter and receiver, and signal analysis equipment is used to determine if perturbations in the electromagnetic field have occurred in response to the presence of an intruder.

In contrast to the aforementioned prior art, the present invention operates in the upper UHF portion of the electromagnetic spectrum that allows both penetration of foliage and the detection of intruders. Microwave beams of the Kiss invention are typically blocked by foliage. The area between the fence-borne antennas and coaxial cable of Gagnon would be cleared of foliage, etc., in the process of installing the system to prevent obstruction of the microwave energy.

The present invention deploys multiple field disturbance transceivers (FDTs) with non-directional antennas in an array along a boundary to be protected. The array may also be deployed in two dimensions surrounding an object or area in need of protection. Essentially every FDT is identical to the others, rather than separate transmitter and receiver modules or complex methods to switch a transmitter and receiver to specific antennas or portions of a leaky coax as seen in the prior art. In the present invention, time division multiplexing and encoding of the transmissions allow each FDT to identify the source of every signal received and to relay data between FDTs. The FDTs transmit in a defined sequence along the array with only the first and last FDT communicating directly with a control station. In contrast, the invention of Kiss requires a UHF link between the central station and each module to accomplish control and receive information. Gagnon's system requires a complex arrangement to couple control signals to each of the switches that connect specific antennas and the coax to the transmitter and receiver functions. Other improvements, features and advantages of the present invention are described in the paragraphs to follow.

BRIEF SUMMARY OF THE INVENTION

The invention described herein provides a high probability of intrusion detection with few false alarms by using a sensor array made up of a multiplicity of field disturbance transceivers (FDTs) placed along a border or perimeter under surveillance, or arranged to protect a two-dimensional area. The emission from the transmitter in each FDT establishes multiple electromagnetic fields between it and the receiving functions in surrounding FDTs. The receiver/signal processor in the receiving FDTs establishes, over a relatively long period (typically minutes), the average electromagnetic field signal level and the average "variation" in that signal level. Intrusion detection is based on the fact that an intruder of interest will cause a disturbance of the electromagnetic field resulting in a change in the signal level at exceeds an automatically generated threshold.

It is an advantage of the present invention that the frequency used is selected to be in the UHF band so that foliage can be penetrated while the person of an intruder will cause a detectable disturbance in the signal propagation between the FDTs.

Another advantage of the present invention is that the FDTs are typically arranged in a sensor array that allows the receiver function in any FDT to receive signals from multiple other nearby FDTs. The transmission from each FDT is encoded with a unique identifier that allows the FDT receiver/signal processor to identify the source of each transmission. The arrangement of FDTs in the array will typically allow six or more independent detections of an intruder traversing through the array. A correlation of these independent detections enables a very high probability of detection and a significant reduction in the false alarm rate.

Still another unique feature of the present invention is that the radio frequency link between FDTs used to detect intrusions is also used to communicate information. The emission from the transmitter is encoded with data that includes identification of the FDT, its status, any commands being relayed from the control station, intrusion detections by it or previous FDTs, etc. This data is relayed down the chain of FDTs until the last unit sends the data to the control station. The control station then relays intrusion detections to a central control station using conventional communications techniques, such as land line or microwave link, where the decision to deploy interdiction forces can be made.

Additional features that make the present invention unique is the very low power required by the transceivers due to very low duty cycle operation using time-division multiplexing. A deployed sensor array is expected to operate continuously for up to two years with a single six-volt battery powering each sensor. Low power consumption allows the units to be easily deployed without the need to provide external power from underground wiring, solar panels, etc.

DESCRIPTION OF THE DRAWINGS

It is to be understood that the drawings are to be used for the purposes of exemplary illustration only and not as a definition of the limits of the invention. None of the figures are drawn to scale. Refer to the drawings in which like reference numbers represent corresponding parts throughout.

DETAILED DESCRIPTION OF THE INVENTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be used, and logical, mechanical, and other changes may be made without departing from the spirit or scope of the present invention. The following detailed description is, therefore, not to be taken in a limiting sense, and the scope of the present invention is defined only by the appended claims.

Figure 1:
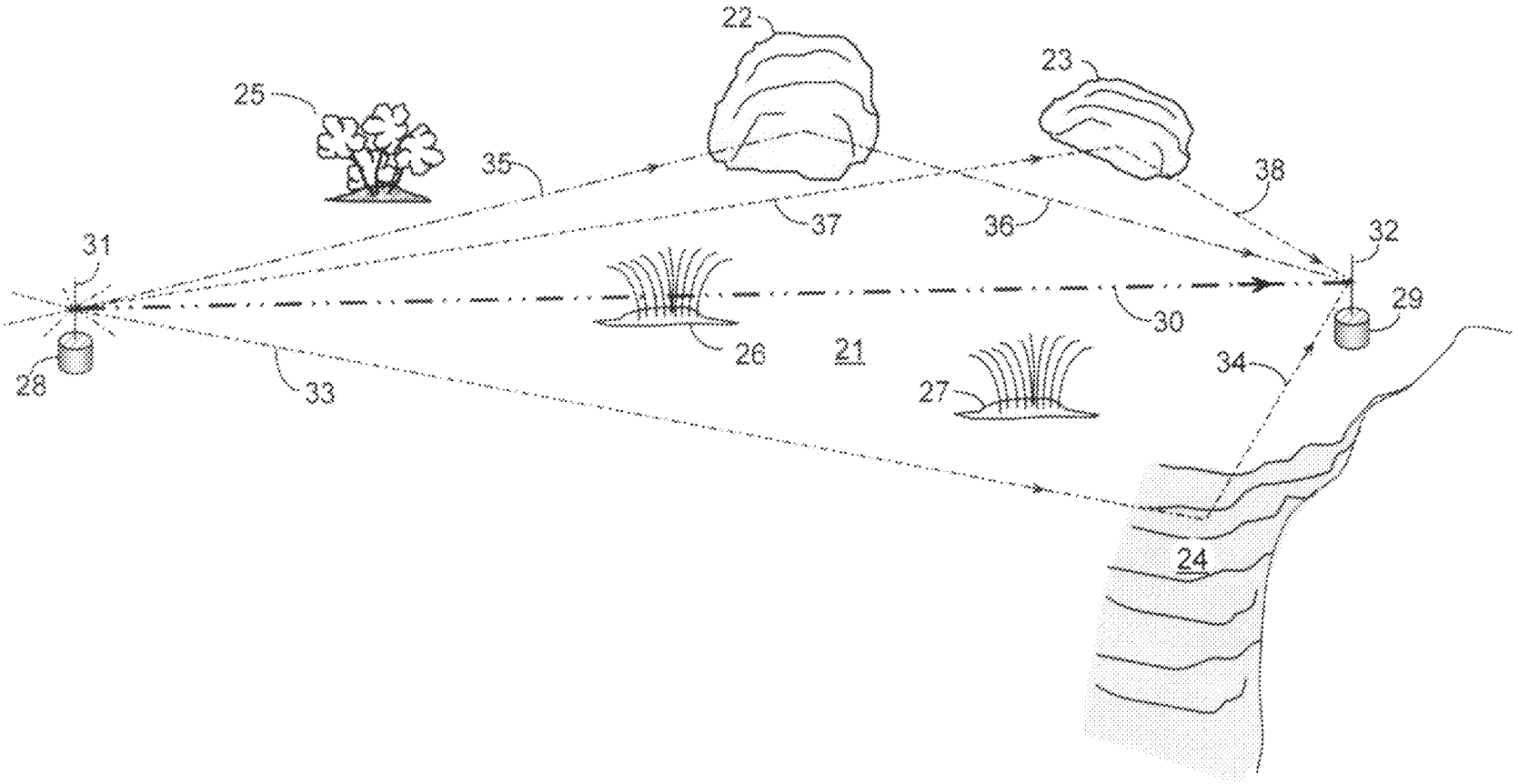
FIG. 1 shows a typical environment 21 along a boundary that must be monitored for the passage of intruders. Transmitter 28 and receiver 29 are deployed for the detection of intruders.
Figure 2:
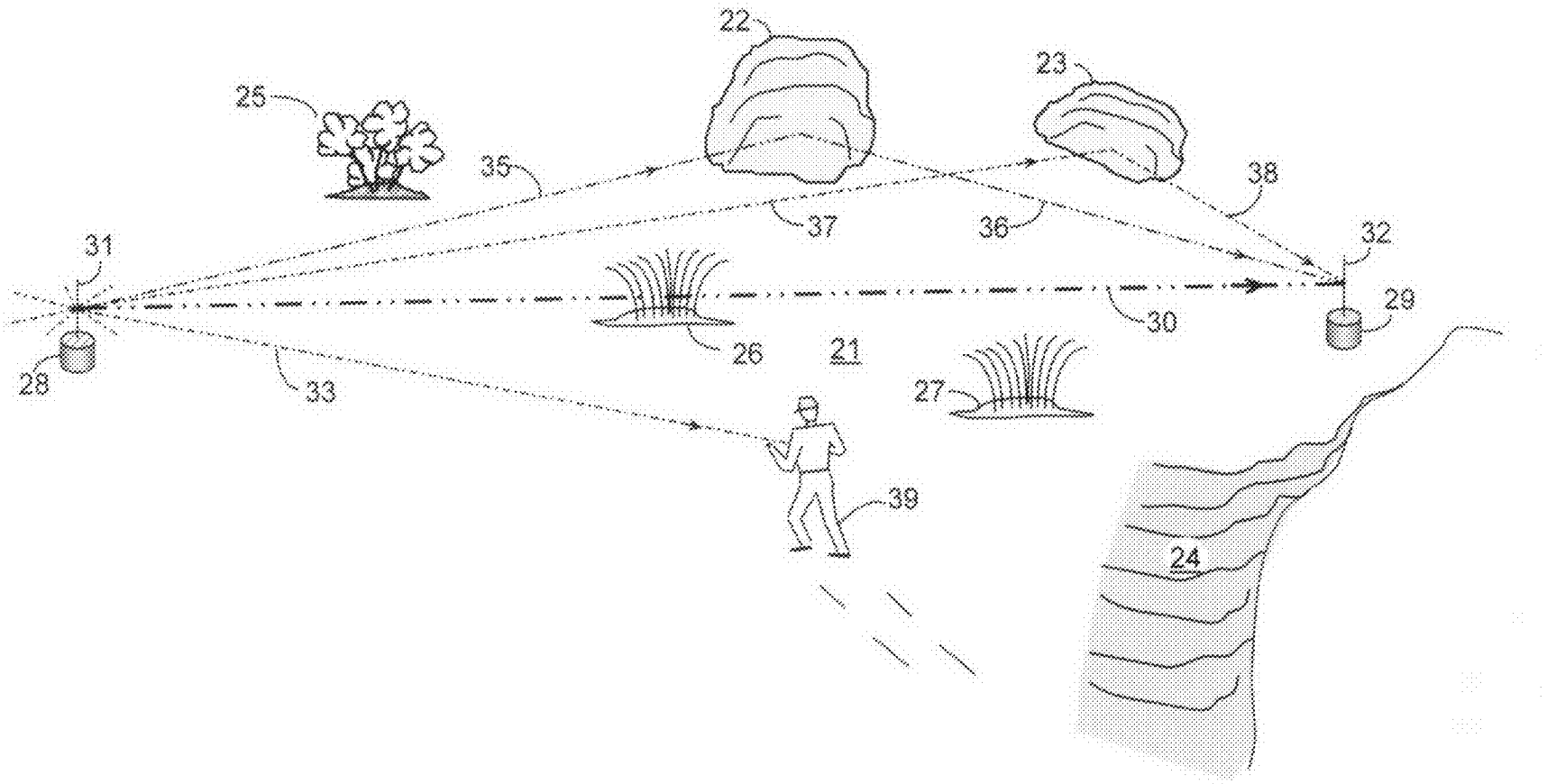
FIG. 2 depicts the same typical environment 21 of FIG. 1, with the addition of an intruder 39 who is in the process of traversing the area protected by transmitter 28 and receiver 29.
Figure 3:
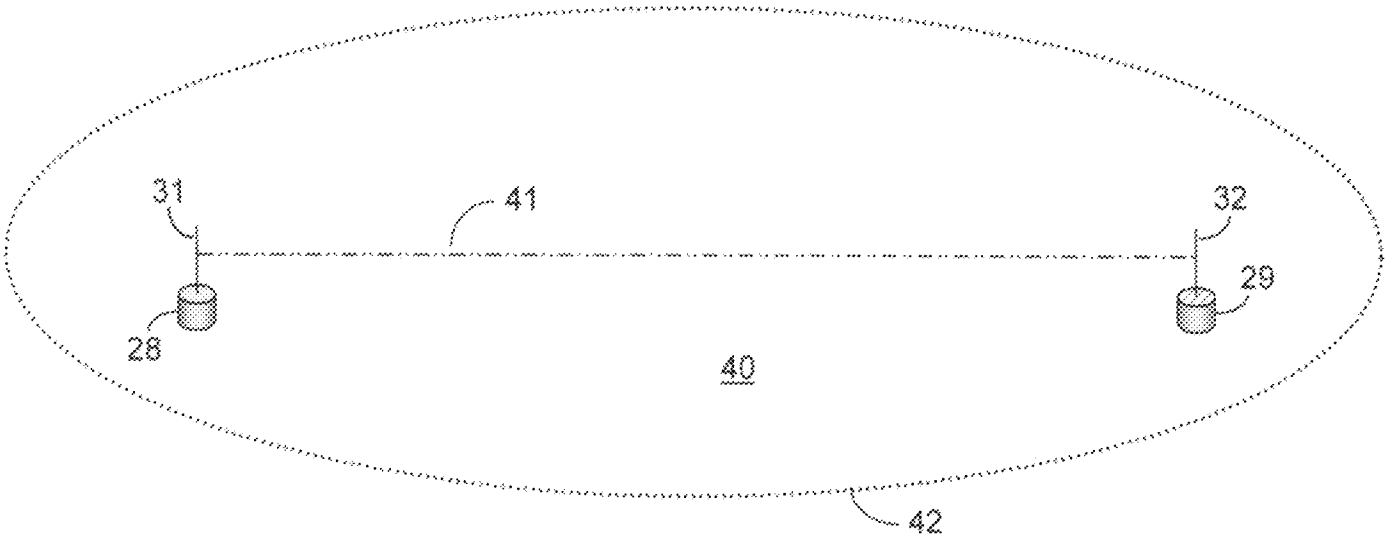
FIG. 3 depicts the typical detection zone 40 existent in the region surrounding a transmitter 28 and a receiver 29.

FIGS. 1, 2 and 3, and the following discussion disclose the method in which disturbances in an electromagnetic field are used to detect the presence of an intruder. FIG. 1 shows a typical environment 21 along a boundary that must be monitored for the passage of intruders. The environment 21 may contain boulders 22 and 23, uneven terrain 24, and various forms of foliage 25, 26, and 27. Other forms of obstructions and vegetation may exist in a real environment. Although the present invention uses transceivers at each sensor location, the discussion of FIG. 1 is simplified by the definition of single purpose units at two locations. Transmitter 28 and receiver 29 are placed at suitable locations so that the likely path of any intruder 39 will intersect the line 30 joining the two. Transmitter 28 is coupled to an omni-directional antenna 31 and receiver 29 is coupled to a similar antenna 32.

Electromagnetic energy emitted by transmitter 28 and radiated by antenna 31 may be depicted by a number of rays that emanate outward from the antenna in all directions. In FIG. 1, only a few of these many rays are shown. If the transmitter 28 and receiver 29 were located in free space, only the energy in the ray depicted by line 30 would be collected by receiver antenna 32. When transmitter 28 and receiver 29 are located on or near the ground in a typical environment as depicted in FIG. 1, additional paths exist for electromagnetic energy to proceed from transmitter antenna 31 to receiver antenna 32. For example, ray 33 proceeds from the transmitter antenna 31 to a portion of the surface of uneven terrain 24 where it is reflected in the form of ray 34 toward receiver antenna 32. Similar reflections of rays 35 and 37 occur off of boulders 22 and 23 thus forming rays 36 and 38 that proceed to receiver antenna 32.

Only a small portion of the many rays that emanate from transmitter antenna 31 and subsequently arrive at receiver antenna 32 are shown in FIG. 1. Those of skill in the art will recognize that the vector sum of all the received rays defines the magnitude of the electromagnetic field existent at receiver antenna 32 due to the emissions from transmitter antenna 31.

FIG. 2 depicts the same typical environment 21 of FIG. 1, with the addition of an intruder 39 who is in the process of traversing the area protected by transmitter 28 and receiver 29. In FIG. 2, the intruder 39 has arrived at the location occupied by ray 33 where the intruder's body blocks the energy in ray 33 and thus prevents its propagation to the receiver antenna 32 by way of ray 34. With the energy in ray 34 removed, the electromagnetic field at receiver antenna 32 has a different magnitude from that when the intruder 39 was not in the vicinity. Items being carried on the person of the intruder may provide surfaces for reflection of rays that could result in additional propagation of energy to the receiver antenna 32. As the intruder proceeds through the area he will block rays 30, 35 and 37 causing additional variations is the magnitude of the electromagnetic field at receiver antenna 32. In addition to the rays shown, the intruder will block other rays not shown with the result that multiple variations in the strength of the electromagnetic field at receiver antenna 32 will occur as the intruder 39 proceeds through environment 21.

By experiment, frequencies of operation have been identified that cause the electromagnetic energy to be blocked by the physical body of a human intruder, as well as by vehicles, etc.; while allowing the energy to pass through typical foliage in the environment of boundaries such as the southern border of the United States. As shown in FIGS. 1 and 2, the emission of an appropriate frequency from transmitter 28 along line 30 proceeds through foliage 26 on its way to receiver antenna 32 while experiencing little to moderate attenuation. An intruder may attempt to use foliage 26 for concealment but will still affect the propagation of electromagnetic energy from the transmitter 28 to receiver 29, and thus will be detected.

The aforementioned experiments have shown that electromagnetic energy of frequencies above 1 GHz will not penetrate foliage sufficiently to allow above 1 GHz operation in the present invention. Experiments conducted at low frequencies (below 5 MHz) revealed that the human body appears to be relatively transparent to energy at these frequencies. At 50 MHz some disturbance of the electromagnetic field was observed but not enough to provide reliable detection. Experiments conducted between the frequencies of 150 MHz and 1 GHz showed the most promising results for detection of intruders in a foliated environment using the techniques described by the present invention. The ISM (Industrial, Scientific and Medical) band from 902 MHz to 928 MHz was chosen for extensive experimentation, since it does not require an operating license if the transmitter power is kept low (typically one milliwatt or less). Additionally, operation in the upper portion of the 150 MHz to 1 GHz range is preferred because efficient antennas that are physically small can be implemented for these frequencies.

FIG. 3 depicts the typical detection zone 40 existent in the region surrounding a transmitter 28 and a receiver 29 operating in the ISM band and separated by a distance 41 of some 30 to 50 meters. Experiments have shown that a target, a walking person or vehicle representing an intruder that enters the detection zone 40, causes a change in the signal level at the receiver 29. The change can either be an increase or a decrease in the received signal level, depending upon whether or not the target reflects or absorbs electromagnetic energy. The size of the target and its proximity to either the transmitter or receiver will also determine the amount of signal change. In the figure, the detection zone 40 is shown being surrounded by a perimeter 42 that approximately defines the area of the detection zone. However, the detection zone does not have abrupt boundaries and will very in dimensions by a few meters depending upon target size, transmitter to receiver separation, terrain and other factors.

The change in signal level due to a human target was found to be typically plus or minus 1 to 2 dB. This change can be detected by comparing the "current" received signal level to the "average" received level established over several minutes of system operation. The effects of weather phenomena; wind, rain, etc., may cause repetitive movement of foliage that results in small variations in the magnitude of the electromagnetic field at the receiver antenna 32, but these tend to be consistently repetitive over an extended period of time, have a magnitude in the order of 0.1 to 0.5 dB, and can recognized as not being from a real intruder target by signal processing. As will be described later, the preferred signal processing algorithms implemented in the present invention take into account those signal variations due to the environment by measuring the variations and setting an automatic threshold to prevent false intrusion detections while maintaining a high probability of true detections.

Figure 4:
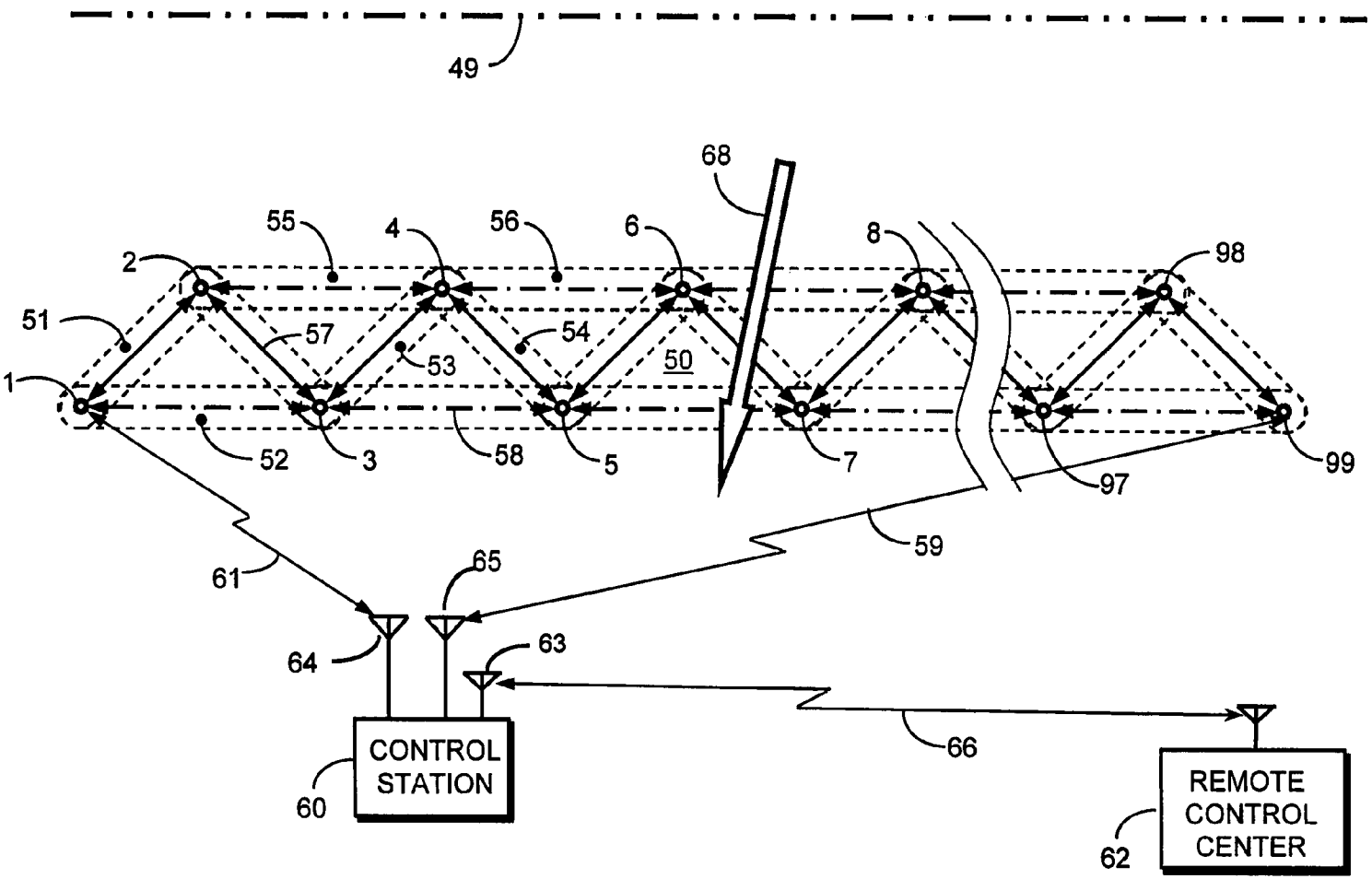
FIG. 4 is an exemplary illustration of an array 50 of field disturbance transceivers (FDTs) in accordance with the present invention that will detect the passage of any intruder transiting through the array.

FIG. 4 is an exemplary illustration of an array 50 of field disturbance transceivers 1, 2, 3, 4, etc., in accordance with the present invention, that will detect the passage of any intruder transiting through the array 50. The array is installed generally parallel to and nearby the boundary 49 to be protected. The array 50 comprises two rows of field disturbance transceivers (FDTs) with typically equal spacing between units along each row and each unit equidistant from the nearest units in the other row. Typical spacing between FDTs closest to each other is about 30 meters. In the preferred embodiment of the invention, the FDTs are buried just below ground level with only their antennas protruding above the surface. Although the array is illustrated as being in a straight line, it can be curved to follow any variations in the path of the boundary 49 being protected. Also, terrain features may necessitate the placement of FDTs at various irregular spacings to provide adequate coverage along steep slopes, in the bottom of washes, etc.

All field disturbance transceivers 1, 2, 3, etc., are identical and include a transmitter function, a receiver function, signal processing capability, and a power source that will allow operation for an extended period. The preferred embodiment of the present invention accommodates as many as ninety-nine FDTs in an array. FDT 1 is located in the first position at the proximal end of the array 50, and FDT 99 is the last unit located at the distal end of the array. The system timing uses a one-second sampling period during which each FDT is provided with an individual transmit period (time slot) of ten milliseconds duration, so that each FDT transmits once in sequence and no two FDTs transmit at the same time. All FDTs in an array transmit on the same frequency. The array can include less than ninety-nine FDTs with some of the time slots not used, but the array timing will remain at a sampling rate of one Hertz. Coverage can be extended as required along the boundary by operating adjacent arrays on different frequencies.

During the period that an FDT is not transmitting, it receives and processes signals transmitted by other FDTs located nearby. During time slots when no nearby FDTs are transmitting, the FDT shuts down most of its circuitry to conserve battery power, keeping only the timing and memory functions active. In this manner, the transmitter duty cycle is maintained at about one percent and the receiver duty cycle is typically about four percent. An individual transmit time slot is programmed into each FDT as part of the system initialization procedure in accordance with the physical configuration of the array.

The transmitted signals are used for both the detection of intruders and for communicating information along the array and to the control station 60 which may be located hundreds of meters distant from the array 50. Control station 60 performs functions that include controlling the operation of the array 50, commanding the initiation of transmit sequences, receiving information from the array regarding the occurrence of any passage of intruders, and evaluating this information to determine the probable location, direction of travel and speed of any detected intruder. The control station 60 then relays its processed information to a remote control center 62 using an internal communication link transceiver coupled to antenna 63. This communication link 66 between the control station 60 and the remote control center 62 may be a microwave link, satellite link, land line, etc. The communication link 66 can have a range capability of 50 miles or more.

Referring to FIG. 4, during its assigned time slot, FDT 1 transmits a signal that is received by FDTs 2 and 3. The result is the generation of two detection zones 51 and 52 that couple FDT 1 to FDTs 2 and 3 respectively. The separation between FDTs 1 and 2 is less than that between FDTs 1 and 3, therefore, detection zone 51 is considered to be a primary detection zone, while the longer detection zone 52 is considered to be a secondary detection zone.

Consider the time slot in which FDT 4 is transmitting; FDTs 2, 3, 5 and 6 are all capable of receiving FDT 4 transmissions and know the origin of these transmissions because they arrive during the time slot assigned to FDT 4. The result is the generation of four detection zones with two being the primary detection zones 53 and 54, and two secondary zones 55 and 56. Once FDT 4 has repeatedly transmitted within its assigned time slot for several minutes, the signal processing circuitry within FDTs 2, 3, 5, and 6 have each developed a history of the average signal level received via their respective detection zones coupling them to FDT 4. Any change in the signal level that exceeds a predefined threshold, either greater or smaller than the average, is identified as the probable detection of an intruder passing through the detection zone.

The internal timing circuitry within each FDT is programmed so that once FDT 1 has completed transmission during its assigned time slot, FDT 2 begins its assigned time slot transmission, and thus sequentially along the array with each FDT transmitting during its unique time slot, until FDT 99 at the distal end of the array completes the sequence. In FIG. 4 the solid lines with arrowheads, for example line 57, define primary lines of detection and communication with the successive transmissions following these solid lines along the array to the distal end. If an FDT should fail and not transmit in its assigned time slot, those FDTs assigned later time slots can continue the sequence with the aid of information obtained by way of secondary lines of detection and communication exemplified by the dashed line 58.

In the typical configuration depicted in FIG. 4, the transmission of FDT 99, during its assigned time slot, is received by the control station 60 by way of communication link 59. The control station then commands FDT 1 to begin another transmit sequence by way of communication link 61. Typically control station 60 will be equipped with high-gain antennas 64 and 65, for example Yagi antennas, that are aimed at the locations of FDTs 1 and 99. The increased antenna gain assures that reliable communications will occur via links 59 and 61.

Each detection zone is evaluated for possible intrusions twice during each transmit sequence. For example, detection zone 54 is evaluated during the time that FDT 4 is transmitting and FDT 5 is receiving, and is evaluated a second time when the roles of these two FDTs are reversed.

Every transmission is encoded with data that includes the identification of the FDT originating the message, any command data from the control station, the FDT's status, and detection data relating to the detection zones that it is monitoring. Each FDT receives data from the preceding units, includes that data in its transmission, and adds any new information that it has developed.

The path of an intruder transiting the array 50 is depicted by arrow 68. The intruder's passage through a detection zone will result in rapid changes in the magnitude of the electromagnetic field that will be detected by the FDT signal processing circuitry. In the process of proceeding through the array, the intruder is shown passing through three different detection zones. Since each detection zone is evaluated twice during each sequence of transmissions, the array 50 and its control station will have a minimum of six opportunities to detect an intruder following the path depicted by arrow 68; assuming that the intruder is not traveling so fast that he transits the array 50 in less than one second. Depending upon the speed that the intruder is moving, he may remain within one or more of the detection zones for a time greater than one second and thus be detected a greater number than six times.

Figure 5:
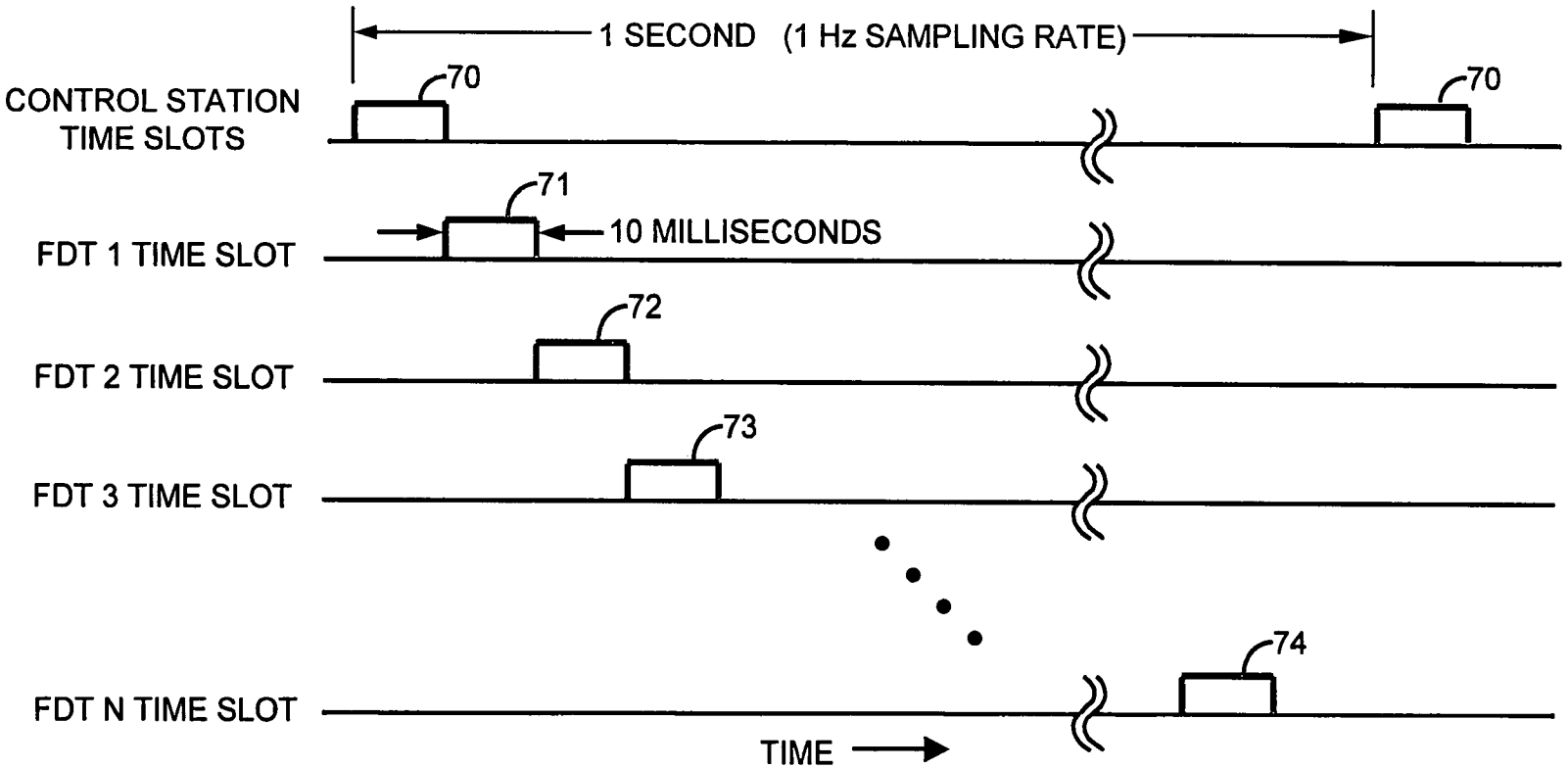
FIG. 5 is an exemplary depiction of the overall system timing used in the field disturbance transceiver (FDT) array.

FIG. 5 is an exemplary depiction of the overall system timing used in the field disturbance transceiver array. The one-second period is divided into 100 equal time slots each of 10 milliseconds duration. Each time slot begins immediately after the end of the previous one. The control station 60 is assigned time slots 70 that occur at the beginning of each one-second period. As each FDT is installed in the array 50 its position along the array is programmed into its internal memory. Thus, the FDT at the proximal end of the array 50 shown in FIG. 4 is designated as FDT 1 and this information is programmed into its memory; the unit in position 2 of FIG. 4 is designated as FDT 2, etc. FIG. 5 depicts the time slot 71 assigned to FDT 1, time slot 72 assigned to FDT 2, and time slot 73 assigned to FDT 3. Time slot 74 is assigned to FDT N that represents the final FDT located at the distal end of the array 50; FDT N is also shown as FDT 99 in FIG. 4. The array can have any number of FDTs up to ninety-nine and the designator N defines the highest numbered FDT in the array. The transmission by the control station 60 of the appropriate message in its time slot 70 begins a sequence of transmissions wherein each FDT transmits its message during its assigned time slot. The sequence of transmissions is concluded by the control station receiving the message transmitted by the $N^{th}$ FDT. The control station may begin the next sequence of transmissions immediately, or may delay for a time to allow data processing, evaluation of the performance of particular FDTs, etc.

The transmission of an FDT is used to both generate the detection zones between it and nearby FDTs and to communicate information relayed along the array to other FDTs, and ultimately to the control station. The use of frequency shift keying and Manchester coding allows the communication of information by using a continuous emission that is appropriately shifted back and forth between two frequencies. The FDT output maintains a continuous signal of constant amplitude during the length of the message thus forming detection zones with other transceivers that can be evaluated for average amplitude and amplitude variations caused by the passage of intruders. As well known to those of skill in the art, Manchester coding involves transitions between two states; in the case of frequency shift keying the two states being the two frequencies. A logic 0 is represented by a transition from the higher frequency to the lower frequency, and a logic 1 is represented by a lower to higher frequency transition. Therefore, each data bit is made up of two sub-bits, one at the lower frequency and the other at the higher frequency.

Although the timing sequence repeats at a one-second rate, ie. a one-Hertz sampling rate, it should be apparent to those of skill in the art that either a higher or a lower sampling can be implemented by the present invention as needed in response to the type or speed of intruders that the system seeks to detect.

Figure 6:
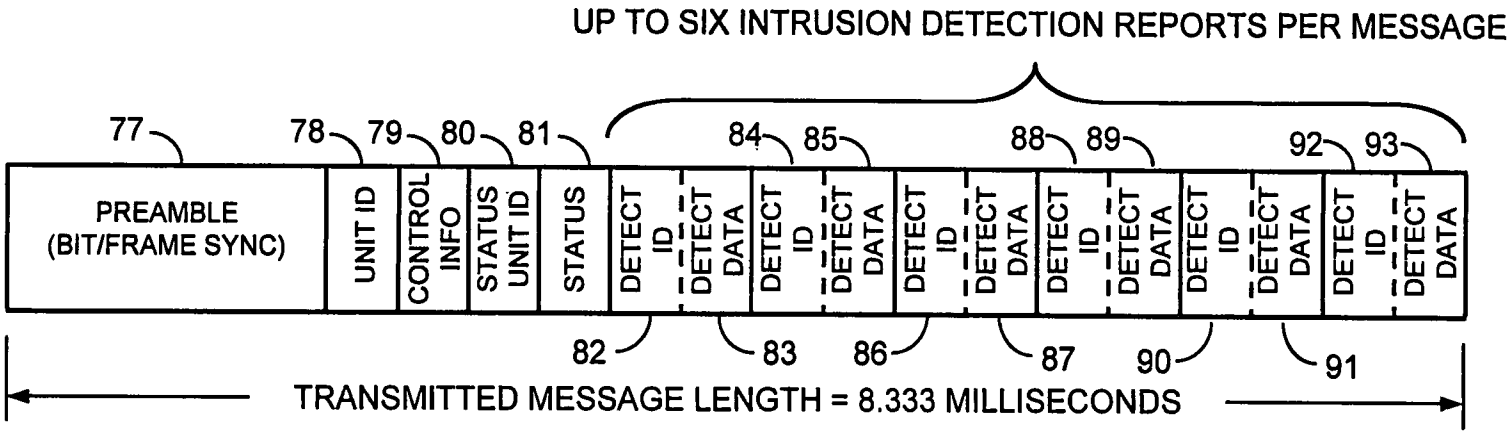
FIG. 6 is an exemplary depiction of the content of each message transmitted by each field disturbance transceiver in the array, as well as by the control station 60 to initiate a sequence of transmissions.

FIG. 6 is an exemplary depiction of the message content of each message transmitted by each FDT in the array, as well as by the control station 60 to initiate a sequence of transmissions. The message comprises twenty words with each word made up of eight bits. Each bit is produced by two Manchester encoded sub-bits that are transmitted at a rate of 26.04 microseconds per sub-bit. A data bit is generated every 52.08 microseconds, and thus the bit rate is 19.2 kilobits per second. The overall length of the twenty-word message is 8.333 milliseconds with the result that each ten-millisecond time slot includes a 1.667-millisecond period of no transmission.

The preamble 77 is four words long and allows the receiver in any FDT receiving the transmission to synchronize to the message. The first three words of the preamble contain a continuous string of alternating ones and zeros that allow a receiver to lock onto the two transmitted frequencies and to synchronize with the bit rate. The fourth word, containing eight bits, has a bit sequence in a unique pattern that allows the receiving FDT to achieve frame sync with the incoming message. This is used to identify the exact start of the first word containing data. By the end of the preamble, the receiving FDT will have achieved frequency lock, bit sync and frame sync to the incoming message.

The data format described in the following paragraphs is exemplary only, those of skill in the art will recognize that alternate formats could be used while still maintaining the objective of the present invention. For example, a check sum word could be substituted at the end of the message to provide transmission error detection instead of using a parity bit to check each data word, etc.

As seen in FIG. 6, the preamble 77 is followed by sixteen data words. Each data word comprises seven information bits and an odd parity bit in the eighth position for the purpose of detecting single bit errors. The first word following the preamble 77 is the unit ID 78 that identifies the unit generating the transmission. The seven information bits provide 128 possible binary combinations. For example, the unit ID word in the transmission from the control station 60 is "0000000", plus the odd parity bit in the eighth position being a "1". The first data word from the first FDT (FDT 1 in FIG. 5) is "00000010"; that is seven bits for binary one and the last bit being the odd parity bit, in this case "0". Each FDT inserts its identification number into the unit ID 78 data word when transmitting a message during its assigned time slot.

The second data word in the transmitted message is identified as control info 79. The control station 60 uses this control info 79 data word to request information or to command specific actions from one or more of the FDTs in the array. Only the control station generates information that is inserted in the control info word. As each transceiver receives the message transmitted by the unit assigned to the time slot immediately preceding its own time slot, it simply repeats the information in the control info 79 word when generating its own message. The exact definition of the various commands are field programmable and can be established when the array is first installed or can be varied at a later date. Using the seven data bits in the word, many different messages are possible. The eighth bit is the word is once again used for error checking. The request for information or command may apply to a specific FDT in the array or may apply to all.

As shown in FIG. 6, the third word after the preamble in the message is identified as the status unit ID 80. This word identifies the specific FDT to which the command or request conveyed in the control info 79 word is directed. If the command or request in the control info word applies to all FDTs in the array, the status unit ID will have the value of zero, and all units will respond to the request in sequence over approximately the next two minutes. As with all other words in the message, the first seven bits are used to convey information and the eight is an odd parity bit.

The fourth data word in the message, status 81, is used by the FDT identified in the status unit ID 80 word to report its status. Table 1 provides the meanings of the various bits in this word.

TABLE 1

| Status 81 Word Content | |
|---|---|
| Bit 1 | A "1" indicates signal being received from unit two time slots back. |
| Bit 2 | A "1" indicates signal being received from unit one time slot back. |
| Bit 3 | A "1" indicates signal being received from unit one time slot forward. |
| Bit 4 | A "1" indicates signal being received from unit two time slots forward. |
| Bits 5-6 | Indicates Battery Level: "11" = Full, "10" = ½, "01" = ¼, "00" = Low |
| Bit 7 | Spare bit for future use |
| Bit 8 | Odd parity error check |

If the status unit ID 80 word does not identify a specific FDT, then each FDT in the array reports its status in sequence. As long as data is found in the status 81 word it is assumed that it came from some FDT positioned earlier in the array and the FDT will simply repeat that information in the status 81 word when generating its message. If an FDT finds no data in the status 81 word, that FDT will assume that it is its turn to report its status and will do so following the format of Table 1.

The final twelve words of the message are used to relay detection reports along the sequence of transmissions and thus to the control station 60. These data words, detect ID 82 through detect data 93, are associated in pairs with the first word of the pair providing the identification of the unit supplying the information that is contained in the second word of the pair. If an FDT detects the presence of what it believes to be an intruder in one of the detection zones 40 that it has in common with surrounding FDTs, it will generate a report to be relayed down the array to the control station. The FDT will then look for an incoming message with a detect ID/detect data pair that is empty and will insert its detection data into that pair. The FDT can use any one of the six detect ID/detect data pairs to make its report. If it finds that all six word pairs already have data inserted by previous FDTs, it will simply keep its report stored in its internal memory until a later sequence of transmissions occurs that has data pairs available for it to report its detection. Each FDT that receives a message containing detection data in any of the detect ID/detect data pairs will simply include that data without change when it generates its message that will be transmitted to the next. FDT down the array.

Both the detect ID and the detect data words have a total of eight bits each. The word pairs 82-83 through 92-93 have the same structure. The format for the information in these two data words is provided in Table 2.

TABLE 2

| Detect ID and Detect Data Word Content | |
|---|---|
| Detect ID | |
| Bits 1-7 | Identify the unit reporting a potential intruder. |
| Bit 8 | Odd parity error check |
| Detect Data | |
| Bit 1 | A "1" indicates detection in the detection zone between the unit reporting and the unit two time slots back. |
| Bit 2 | A "1" indicates detection in the detection zone between the unit reporting and the unit one time slot back. |
| Bit 3 | A "1" indicates detection in the detection zone between the unit reporting and the unit one time slots forward. |
| Bit 4 | A "1" indicates detection in the detection zone between the unit reporting and the unit two time slots forward. |
| Bits 5-6 | Indicates the relative amplitude of the detection:<br>"11" indicates a strong detection.<br>"10" indicates a moderately strong detection.<br>"00" indicates a weak detection.<br>(If more than one of the bits 1-4 are a "1" the strongest is used to report amplitude.) |
| Bit 7 | A "1" indicates a complete loss of signal from both previous units. |
| Bit 8 | Odd parity error check |

If an FDT at any position along the array fails due to signal blockage, tampering, battery failure, etc., the next unit in line transmits in its assigned time slot, even though it did not receive a message from the failed unit, but did receive the message from the FDT located two times slots earlier in the array. If an FDT does not receive the expected messages in the two time slots immediately preceding its assigned time slot, the message that it transmits in its assigned time slot will include information (detection data word, bit 7) that there is a problem in the array. Any FDT that loses contact with the previous two units increases the receive window of its receiver to determine if any previous transmissions can be heard. If it can receive earlier transmissions, the system integrity and timing can be maintained, although with a gap in coverage until the problem can be repaired.

At the control station 60, information from the last unit in the array is received and processed to determine the overall system status and any intrusions that have occurred. This information is then passed on to a remote control center 62 via a secondary communication system 63.

Although this exemplary embodiment of the present invention is taught on the basis of the use of two-frequency Manchester modulation and the encoding of data as presented in the forgoing discussion and tables; those of skill in the art will recognize that other modulation techniques and data encoding methods having equivalent performance will fall within the broad scope of the present invention.

In the exemplary embodiment of the present invention, the signal to noise ratio at the input to the receiver must be sufficiently high that variations in the received signal caused by the passage of an intruder through a detection zone 40 can be distinguished from variations due to noise generated within the receiver. The equivalent input noise level, N, is defined by an equation well known to those of skill in the art:

$$N=kT_O B\overline{NF}$$

where k is Boltzmann's constant ($1.38\times10^{-23}$ watts/Hz/° K), $T_O$ is the assumed temperature of the receiver input circuits, ($T_O$=290° K), B is the approximate noise bandwidth of the RF band-pass filter in the FDT receiver, and $\overline{NF}$ is the noise figure of the receiver input circuits.

The RF bandwidth of the FDT receiver is approximately matched to the characteristics of the Manchester encoded signal being received. The sub-bits of the modulation occur at a rate of $38.4\times10^3$ bits per second and the frequency separation between the two modulation frequencies is 64 kHz. The result is a required RF bandwidth of approximately 104 kHz. Typical band-pass filters do not have "vertical" band edge characteristics and thus the noise bandwidth is somewhat greater than the required RF bandwidth. The FDT receiver has a noise bandwidth, B, of approximately 130 kHz. Since a large number of FDTs are used in each array, it is highly desirable that the cost per FDT be minimized. Low cost, commercially available, integrated circuits are used in the receiver front end that have a noise figure of approximately 12 dB, and the following analysis reveals that this level of performance is adequate. Solving the equation and converting the result to decibels relative to one milliwatt, yields an equivalent input noise level of −110.9 dBm.

The signal to noise ratio at the input to the receiver is a comparison of the received signal strength to the equivalent input noise level. The Manchester encoded, frequency shift keyed waveform is non-coherently demodulated by the receiver to extract the data contained in the incoming message. A minimum signal to noise ratio of some 15 dB is required to accomplish this demodulation with a low probability of error. The link margin is a measure of how much greater the incoming signal is compared to the equivalent input noise plus the minimum signal to noise ratio necessary for reliable demodulation of the received waveform.

Well known to those of skill in the art is the relationship between the parameters that determine the received signal level, $S_r$, at the input to an FDT receiver produced by a transmission from another nearby unit. The relationship is:

$$S_r=(P_T\times G_{TA}\times G_{RA}\times\lambda^2)/((4\pi)^2\times R^2\times L_T\times L_F\times L_P\times L_A)$$

Table 3a provides the meaning of each of the terms, and their values in the exemplary embodiment of the present invention expressed in some cases both in conventional units and their conversion to decibel equivalents. Polarization loss, $L_P$, is negligible since all antennas in the array and control station have the same polarization. Atmospheric loss, $L_A$, is also negligible at the frequency of operation and the distances involved. Foliage losses, $L_F$, are listed at 10 dB in the table, a value that is considered a maximum that is expected in typical installations of the present invention. Values for range and the received signal level are blank in Table 3a since solving the equation will determine the signal level at various ranges. Several sample solutions of the equation for different ranges are presented in Table 3b.

TABLE 3a

Field Disturbance Transceiver RF Link Analysis Inputs

| | | | | | |
|---|---|---|---|---|---|
| $S_r$ | Received signal level | | | | dBm |
| $P_T$ | Transmit power | 1 | mW | 0.0 | dBm |
| $G_{TA}$ | Transmit antenna gain | | | 1 | dB |
| $G_{RA}$ | Receiver antenna gain | | | 1 | dB |
| l | Wavelength of transmitted signal | 0.328 | M | −4.84 | dB |
| 4 p | Constant re. area of sphere | 12.57 | | 10.99 | dB |
| R | Range | | M | | dB |
| $L_T$ | Transmit losses | | | 1 | dB |
| $L_F$ | Foliage losses | | | 10 | dB |
| $L_P$ | Polarization loss | | | 0 | dB |
| $L_A$ | Atmospheric loss | | | 0 | dB |
| $G_C$ | Comm. antenna gain | | | 15 | dB |

TABLE 3b

Field Disturbance Transceiver RF Link Analysis Signal Strengths

| | Minimum Range | Typical Range | Maximum Range | Extreme Range |
|---|---|---|---|---|
| Range (meters) | 10 | 30 | 50 | 100 |
| Received Signal (dBm) | −60.7 | −70.2 | −74.6 | −80.7 |
| Signal-to-Noise Ratio (dB) | 50.2 | 40.7 | 36.3 | 30.2 |
| Link Margin (dB) | 35.2 | 25.7 | 21.3 | 15.2 |

Table 3b reveals that the link margin between adjacent FDTs is adequate for an FDT to FDT spacing of 100 meters or more. For optimum intrusion detection performance, a spacing between adjacent FDTs of 30 meters is preferred. At this spacing the link margin exceeds 25 dB.

If one assumes that the array 50 depicted in FIG. 4 is laid out in a straight line and that the FDTs along the bottom row (most distant from the boundary 49) are uniformly spaced at 30 meters, and that this bottom row comprises fifty units starting at FDT 1 and ending with FDT 99; then the total length of the array is 1470 meters. A spacing of 50 meters yields an overall length of 2450 meters. As depicted in FIG. 4, the control station 60 must communicate with both FDT 1 and FDT 99. If the control station is placed essentially equidistant from these two end FDTs and back from the array 50 by some 200 meters, and the FDT to FDT spacing is 30 meters; then simple geometry yields a distance between the control station and either end FDT of 762 meters. A uniform FDT spacing of 50 meters results in a control station to end FDT distance of 1241 meters.

Several parameters in the received signal level equation must be considered in order to determine the link margin in the signal paths between the control station and the end FDTs. The control station 60 is equipped with directional antennas 64 and 65 that will provide some 15 dB gain for either transmit or receive. The Yagi antenna is a typical example of such an antenna. The link margin can be improved by 10 dB by positioning the control station antennas so that the signal path will not penetrate any foliage between the control station and the FDT. When these values are applied to the received signal level equation the results shown in Table 3c are obtained.

TABLE 3c

Control Station to Field Disturbance Transceiver RF Link Analysis

| | $L_F$ = 10 dB | | $L_F$ = 0 dB | |
|---|---|---|---|---|
| Range (meters) | 762 | 1241 | 762 | 1241 |
| Received Signal (dBm) | −84.3 | −88.6 | −74.3 | −78.6 |
| Signal-to-Noise Ratio (dB) | 26.6 | 22.3 | 36.6 | 32.3 |
| Link Margin (dB) | 11.6 | 7.3 | 21.6 | 17.3 |

If field installations of the present invention reveal that it is desirable to position the control station 60 at a greater distance than 200 meters from the array 50, then several modifications can be made to the control station to facilitate the greater separation. Such modifications can include using a transmitter power significantly greater than one milliwatt, using a low noise receiver front end with noise figure much less than 12 dB, and directional antennas 64 and 65 having gain greater than 15 dB.

Figure 7:
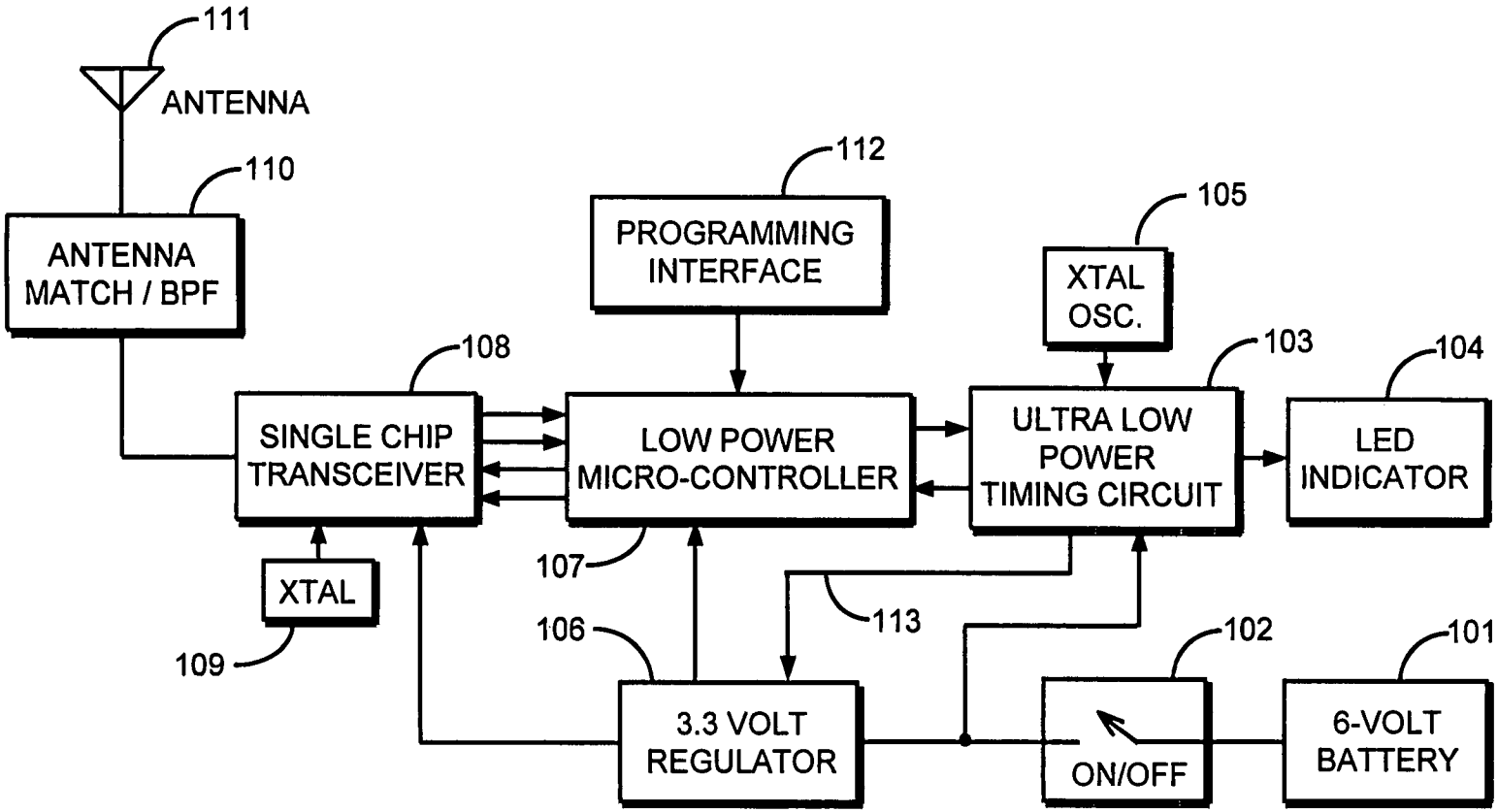
FIG. 7 is an illustration showing the block diagram of the field disturbance transceiver included in the exemplary embodiment of the present invention.

FIG. 7 is an illustration showing the block diagram of the field disturbance transceiver (FDT) included in the exemplary embodiment of the present invention. Power is supplied by a 6-volt lantern battery 101 that is coupled to the FDT circuitry via the ON/OFF switch 102. The switched 6-volt power is supplied to the ultra low power timing circuit 103 that determines when other circuits within the FDT are to "wake-up" and perform their functions. When not issuing commands, this ultra low power timing circuit 103 has a continuous current consumption of less than 100 microamperes. Crystal oscillator 105 provides the time reference that enables each FDT to transmit within its assigned time slot as described in the discussion of FIG. 5 above. When 6-volt power is supplied to the ultra low power timing circuit 103, it in turn, supplies short power pulses to the LED indicator 104 approximately every 30 seconds. The brief flashes emanating from the Light Emitting Diode (LED) provide an indication to an observer that the FDT is operational. Alternatively, the LED indicator 104 can be commanded to not flash, thus conserving power and not drawing attention to the location of the FDT.

At appropriate times, the ultra low power timing circuit 103 generates power enable commands 113 that are sent to the 3.3-volt regulator 106. This regulator converts the 6-volt battery power to a constant 3.3-volt level and then supplies this regulated power to the single chip transceiver 108 and to the low power microprocessor 107 at the appropriate times and for sufficient durations to allow these circuits to perform their functions. During those periods when the transceiver circuits are neither receiving nor transmitting and the microprocessor is not performing any calculations, the ultra low power timing circuit 103 commands (via power enable 113) the 3.3-volt regulator 106 to shut off the power to the transceiver and microprocessor so that the operational lifetime of the FDT will be maximized. Power to the memory contained within the low power micro-controller is continuous to maintain signal level statistics. Typical operational lifetime between battery changes for the present invention is two years.

Antenna 111 enables the FDT to form, in cooperation with other FDTs, the detection zones 40 and to communicate with the other FDTs and the control station 60 as required. The antenna matching network and band pass filter (Antenna Match/BPF) 110 provides optimum coupling between the antenna 111 and the single chip transceiver 108. It also attenuates out-of-band signals to prevent overloading of the single chip transceiver front end and to improve the system signal-to-noise ratio.

The single chip transceiver 108 and low power micro-controller 107 in one exemplary embodiment of the present invention employs the Texas Instruments CC1010. This chip is capable of operation in the 902 to 928 MHz ISM band. Using the crystal 109 as a reference, the chip can be programmed to operate in any one of 25 one-megaHertz wide channels within that band. All FDTs used in a single array operate within the same channel. The FDTs in other nearby arrays can be programmed to operate on other channels to minimize any possible interference. The modulation for both transmission and reception is frequency shift keyed Manchester coding with a frequency separation between the two modulation frequencies of 64 kHz. The sub-bits are generated at a rate of 26.04 microseconds per sub-bit, thus a data bit is generated every 52.08 microseconds, and the bit rate is 19.2 kilobits per second.

When a transmission from another FDT is first received, the low power micro-controller 107 assists the single chip transceiver 108 to achieve frequency lock, bit sync and frame sync to the incoming message. Thereafter, the transceiver sends to the micro-controller both an analog waveform with amplitude representative of that of the received signal and the decoded signal as a digital bit stream. The low power micro-controller 107 extracts the information content of the incoming message in accordance with the format described in conjunction with FIG. 6 and Tables 1 and 2 above. The micro-controller also evaluates the amplitude of the incoming signals and compares it to a history of signal strengths of the transmissions from the particular FDT being received. The micro-controller may then declare that an intruder appears to be passing through the subject detection zone.

The FDT typically operates in one of two modes. The first is an initialization mode wherein the single chip transceiver 108 is commanded to listen continuously for any transmission from another FDT or the control station. Once an FDT has received a transmission from another FDT that includes that FDT's assigned number and time slot, it can then determine when its assigned time slot will occur. The FDT then switches to an operational mode in which the ultra low power timing circuit 103 will command that the single chip transceiver 108 and low power micro-controller 107 turn on and receive only those transmissions from those FDTs that form detection zones 40 with the subject FDT. The micro-controller also generates the appropriate message and sends it to the single chip transceiver to be transmitted during its assigned time slot. The message is transmitted once per second at a power lever of approximately one milliwatt and has a length of some 8.333 milliseconds. Thus, the average transmitted power is less than ten microwatts.

The FDT includes a programming interface 112 that allows all necessary parameters to be programmed into the FDT, usually at the time it is installed as one unit of an array 50. A lap-top computer is typically coupled to the programming interface 112 by an appropriate cable and various parameters inserted into the memory of the low power micro-controller 107. Parameters to be down-loaded may include the channel of operation, this FDT unit number and time slot, and any threshold data that may be required to minimize false alarms while maximizing the detection of expected intruders.

It is noted that, although a specific embodiment has been illustrated and described herein using a commercially available circuit, it will be appreciated by those of ordinary skill in the art that any arrangement designed to achieve the same purpose may be substituted for the specific embodiment shown. This application is intended to cover any adaptations or variations of the present invention. Therefore; it is manifestly intended that this invention be limited only by the claims and equivalents thereof.

Figure 8:
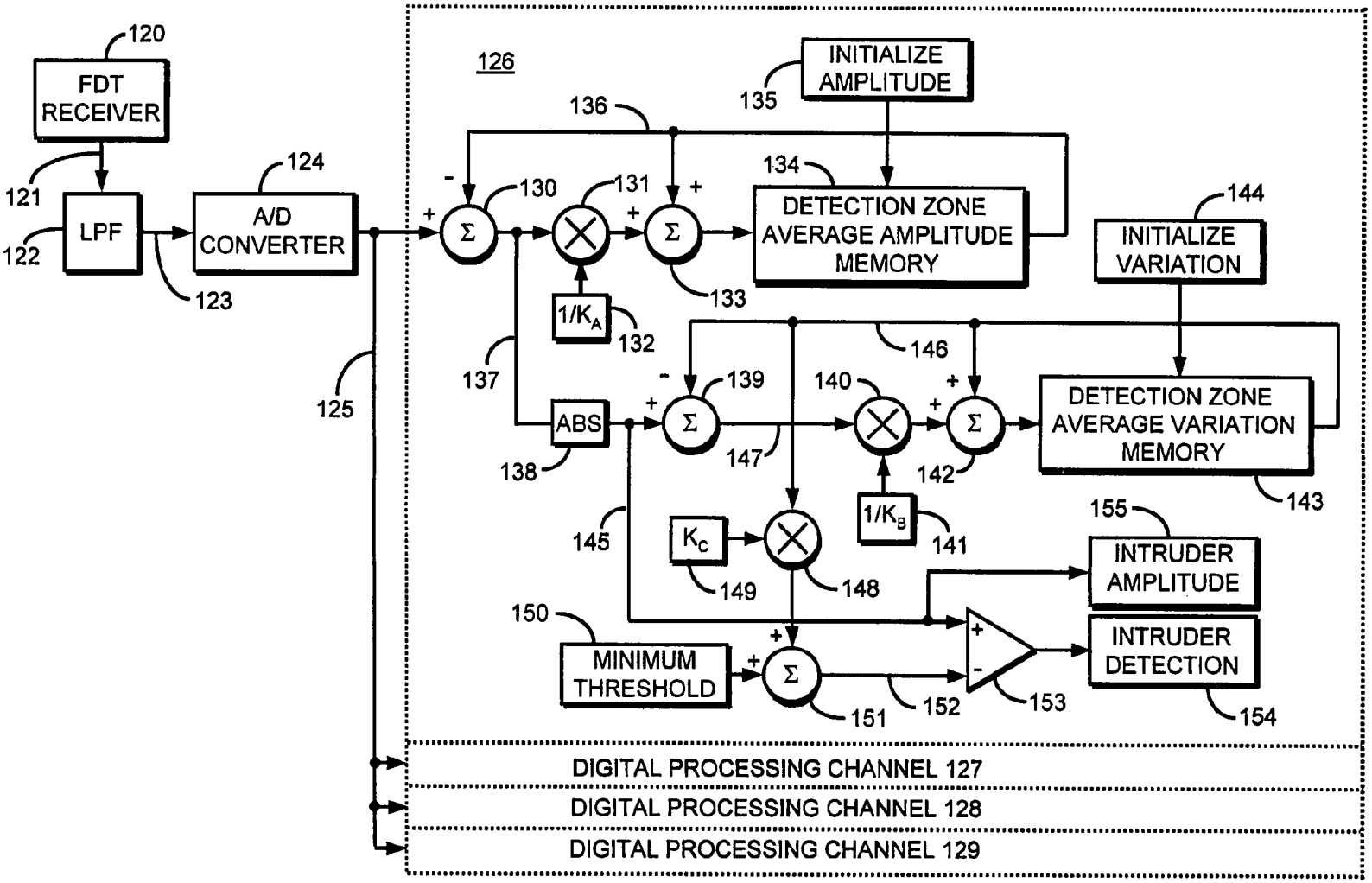
FIG. 8 depicts the process used to evaluate signals received by a field disturbance transceiver to detect the presence of an intruder.

FIG. 8 depicts the process used to evaluate signals received by an FDT to detect the presence of an intruder. Each FDT includes the FDT receiver 120, low pass filter (LPF) 122, the ND converter 124, and multiple processing channels with each channel having the same configuration as that of the digital processing channel 126. Each FDT is programmed to evaluate the signals received from several detection zones 40 formed when nearby FDTs transmit during their assigned time slots. A digital processing channel is assigned to each of the detection zones. Normally an FDT evaluates the detection zones formed by signals transmitted by the FDTs assigned the two time slots preceding the subject FDT's time slot and the two FDTs assigned the two time slots following. By means of the programming interface 112, shown in FIG. 7, or by commands from the control station 60, an FDT can be programmed to receive transmissions from up to six unique time slots to accommodate various non-standard physical configurations of the array 50. This modification requires that additional digital processing channels be added to accommodate the two additional time slots. The addition of channels requires only changes and additions to the software programmed into the low power micro-controller 107, shown in FIG. 7.

The FDT receiver 120, included within the single chip transceiver 106 shown in FIG. 7, is normally activated only during those times when nearby FDTs are transmitting within their assigned time slots. An FDT transmits a signal of 8.333 milliseconds duration once each second. The FDT receiver 120 produces an analog output 121 with amplitude that is proportional to the strength of the signal received from the nearby FDT, and with a rectangular-like waveform of shape and duration similar to the received signal. The analog output 121 is passed through a low pass filter (LPF) 122 that has a time constant of approximately two milliseconds. The low pass filter attenuates any high frequency components in the analog output and produces a band limited LPF output 123 that, during the latter portion of the waveform, achieves an amplitude that is equivalent to the average amplitude of the receiver analog output 121.

The A/D converter 124 takes a sample of the LPF output 123 near the end of the waveform to assure that the sample is representative of the received signal average value. The A/D converter 124 produces a 12-bit digital word that is the digital equivalent of the analog signal amplitude at its input. Only one sample is taken for each FDT signal received. FDT signals are received from several detection zones during each one-second sampling period, and the resulting digitized samples 125 are distributed to the multiple digital processing channels 126, 127, 128, 129, etc., that are assigned to the different detection zones.

The digital processing channel 126 carries out several mathematical computations using as its inputs the once-per-second digitized samples 125 supplied to it by the ND converter 124. Included in FIG. 8 are symbols for a sum function in the form of a circle enclosing a Σ, and with the qualifiers, plus + and minus − associated with each input. The output of the sum function is dependent upon these qualifiers; if both input qualifiers are plus, the two inputs are added; if one input qualifier is a minus, then that input is subtracted from the other. A second symbol that defines a multiply function has the form of a circle enclosing an X. This symbol indicates that the two inputs are multiplied by each other to form the output of the multiply function. If the two inputs are A and B, then the output C has the value: C=AB. If one input is changed to the form 1/E then the output is: C=A/E. Thus the multiply function can be used to either multiply or divide the two inputs.

Those of skill in the art will understand that the functions shown in FIG. 8 may be performed by individual circuits designed to perform the specific mathematical computations, or these functions may be realized as elements of code programmed for a microprocessor. These or any other combination of physical or computational means to carry out the defined mathematical computations fall within the broad scope of the present invention. All computations shown for the digital processing channel 126 are carried out within the present invention by the low power micro-controller 107 shown in FIG. 7.

The functions shown in the upper portion of the digital processing channel 126 have as their purpose the determination of the average amplitude of the signals being received in the detection zone to which this processing channel is assigned. When the FDT is first activated and begins receiving signals from the detection zone, the initialize amplitude function 135 stores the amplitude of the first received signal in the detection zone average amplitude memory 134. Thereafter, each time a signal is received from the detection zone, its amplitude in the form of A/D converter output 125 is subjected to a series of computations to form a new value that then replaces the value previously stored in the detection zone average amplitude memory 134.

The sum (Σ) function 130 subtracts the detection zone average amplitude memory output 136 from the ND converter output 125. If the signal amplitude received from the detection zone is exactly the same as the average amplitude stored in the memory, then the output 137 of the sum function 130 will be zero. If the two are not equal, then the output of the sum function will have a value equal to the difference with polarity dependent upon whether the ND converter output 125 is greater or less than the memory output 136. The sum function 130 output is the bi-polar variation signal 137 that is supplied to the multiply function 131.

The multiply function 131 is supplied two inputs; the bi-polar variation signal 137 and a computed constant 132 of the form $1/K_A$. The constant $K_A$ has a typical value of 16, but its value can be changed as necessary by way of the FDT programming interface 112. The multiply function 131 output is the bi-polar variation signal reduced in amplitude by division by the constant $K_A$, and is supplied to a second sum (Σ) function 133.

Sum (Σ) function 133 is configured to add its two inputs. One of these inputs is the memory output 136 from the detection zone average amplitude memory 134, and the second input is the bipolar variation signal 137 reduced in amplitude by the effect of the constant $K_A$. The sum of these two digital words then defines a new value that replaces the old data stored in the detection zone average amplitude memory 134. The result, of these computations imposed on the bi-polar variation signal 137, is to prevent any single large variation from the average to have a significant effect upon the value stored in the memory, but changes in the average signal value over a number of samples will result in proper adjustments to the average amplitude stored in the memory.

The functions shown in the middle portion of the digital processing channel 126 have as their purpose the determination of the average variation of the signals being received in the detection zone. When the FDT is first activated and begins receiving signals from the detection zone, the initialize variation function 144 stores a value of zero in the detection zone average variation memory 143. Thereafter, each time a signal is received from the detection zone and a new value is computed for the bi-polar variation signal 137, computations occur to form a new value to be stored in the detection zone average variation memory 143.

The bi-polar variation signal 137 is passed through an absolute value (ABS) function 138 that produces a variation amplitude signal 145 that has a positive value equivalent to the magnitude of the bi-polar variation signal irrespective of its sign. The detection zone average variation memory 143 contents is defined as the memory output 146. The sum (Σ) function 139 subtracts the memory output 146 from the variation amplitude signal 145. If the variation amplitude signal 145 is exactly the same as the memory output 146, then the output produced by the sum function 139 will be zero. If the two are not equal, then the sum function output will have a value equal to the difference with polarity dependent upon whether the variation amplitude signal 145 is greater or less than the memory output 146. The sum function 139 output is the variation difference signal 147 that is supplied as one input to the multiply function 140.

The multiply function 140 second input is a computed constant 141 with a value of $1/K_B$. The constant $K_B$ has a typical value of 16, but its value can be changed as necessary by way of the FDT programming interface 112. The multiply function 140 output is the variation difference signal 147 reduced in amplitude by division by the constant $K_B$.

Sum (Σ) function 142 is configured to add its two inputs. One of these inputs is the memory output 146 from the detection zone average variation memory 143, and the second is the variation difference signal 147 reduced in amplitude by the effect of the constant $K_B$. The sum of these two signals then defines a new value that replaces the old data stored in the detection zone average variation memory 143. The result, of these computations imposed on the variation amplitude signal 145, is to prevent any single large departure from the average variation to have a significant effect upon the value stored in the memory, but changes in the variation amplitude signal value over a number of samples will result in proper adjustments to the average variation stored in the memory.

The functions shown in the lower portion of the digital processing channel 126 have as their purpose the detection of the presence of an intruder in the detection zone to which the digital processing channel is assigned. When an intruder is present in the detection zone, the amplitude of the A/D converter output 125 will vary significantly from values obtained before the intruder presence, and will also vary significantly from sample to sample. This disturbance will be greater than the normal variation that occurs in signal amplitude as multiple signals are received from the detection zone with no intruder present.

The presence of the intruder will cause the magnitude of the bi-polar variation signal 137 to increase and that will in turn cause an increase in the variation amplitude signal 145. Environmental factors such as foliage being disturbed by a wind gust can also cause small, temporary increases in the variation amplitude signal 145. Therefore, a threshold is set that must be exceeded before any disturbance will be declared to be the result of the presence of an intruder.

The memory output 146 from the detection zone average variation memory 143 is supplied as one input to the multiply function 148; the constant $K_C$ is the second input. This constant $K_C$ normally has a value of one (1), but can be set at a value more or less than one, by way of the FDT programming interface 112, depending upon the conditions found in the location where the array 40 is deployed. The memory output 146 multiplied by the constant $K_C$ is added to the value stored in the minimum threshold 150 by the sum function 151. The result is a detection threshold 152 that is greater in amplitude than the detection zone average variation memory output 146 by the contribution of the minimum threshold 150 and the multiplier $K_C$.

The detection threshold 152 is supplied as the negative input to the comparator 153 while the variation amplitude signal 145 provides the positive input. If the disturbance to the normal signals being received from the detection zone is sufficiently great that the variation amplitude signal 145 exceeds the detection threshold 152, the comparator 153 produces a positive output that causes the intruder detection function 154 to declare that an intruder is present in the detection zone. The intruder amplitude function 155 records and evaluates the value of the variation amplitude signal 145, and categorizes it as a strong, moderate, or weak detection. The detection data is then passed to other portions of the low power micro-controller 107 where a detection message is composed to be relayed to the control station 60.

Figure 9:
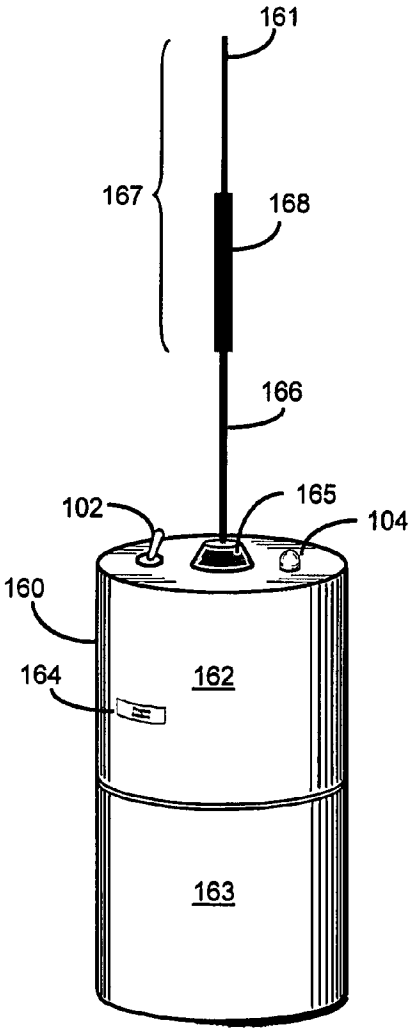
FIG. 9 is an exemplary depiction of the field disturbance transceiver housing 160 including its attached antenna 161.

FIG. 9 is an exemplary depiction of the field disturbance transceiver (FDT) housing 160 including its attached antenna 161. The FDT housing has the form of a cylinder that is 10.8 centimeters (4.25 inches) in diameter by 15.3 centimeters (6.0 inches) high (the drawing is not to scale). The housing is fabricated of a suitable moldable plastic material such as glass filled polypropylene, and comprises two parts with the upper part being the electronics enclosure 162 and the lower part being the battery container 163. The battery container is screwed onto a threaded sleeve projecting downward from the lower rim of the electronics enclosure, and an o-ring seal is incorporated in the mating surfaces to prevent intrusion of the external environment into the housing.

A commercially available alkaline lantern battery is installed in the battery container 163. A typical example of a battery used in the present invention is the 6-volt Eveready Energizer 529 that has a capacity of over 20,000 milliAmpere-Hours.

Included within the electronics enclosure 162 is a circuit board that provides all the required interconnections and mounting surfaces for the circuit elements shown in FIG. 7. The programming interface 112 includes an inductive transducer that is mounted on the circuit board in close proximity to the inner wall of the electronics enclosure 162. The outer surface of the electronics enclosure directly outside the location of the inductive transducer is marked with a suitable label 164 to indicate its internal location.

The on/off switch 102 and the LED indicator 104 are both mounted on the upper surface of the electronics enclosure. An alternate configuration of the on/off switch includes a "tilt" switch mounted on the circuit board. This tilt switch will move to the "on" position only when the FDT is in an upright position with the antenna 161 pointed upward. When the tilt switch version of the on/off switch is used, the FDTs are stored and transported with the housing 160 maintained in a horizontal position. Only when the FDT is prepared for deployment in an array will the unit be placed in a vertical position, and the tilt switch will supply power to the internal circuitry.

The antenna 161 is coupled to the circuitry within the FDT housing 160 by a combination antenna mount and connector 165. The antenna can be stored and transported separately from the FDT housing, and can be attached when the FDT is ready for deployment. The antenna 161 includes a lower portion that is a semi-rigid coax cable 166 of approximately one-half to one meters (20 to 40 inches) length terminated by a one-quarter wavelength dipole antenna 167 with a tubular groundplane 168 extending down over the upper portion of the coax cable. The semi-rigid coax cable is of sufficient length that the FDT housing can be buried some 15 centimeters (6 inches) deep and the dipole antenna 167 feed point will still be 35 to 85 centimeters (14 to 33 inches) above the ground surface. In some installations it may be highly desirable to camouflage the antenna so that will be improbable that intruders will be aware of the FDT locations. A flexible plastic molding, enclosing the antenna, that has the appearance of the stalk of a weed, long blade of grass, etc., can be added to the antenna for camouflage purposes.

Figure 10:
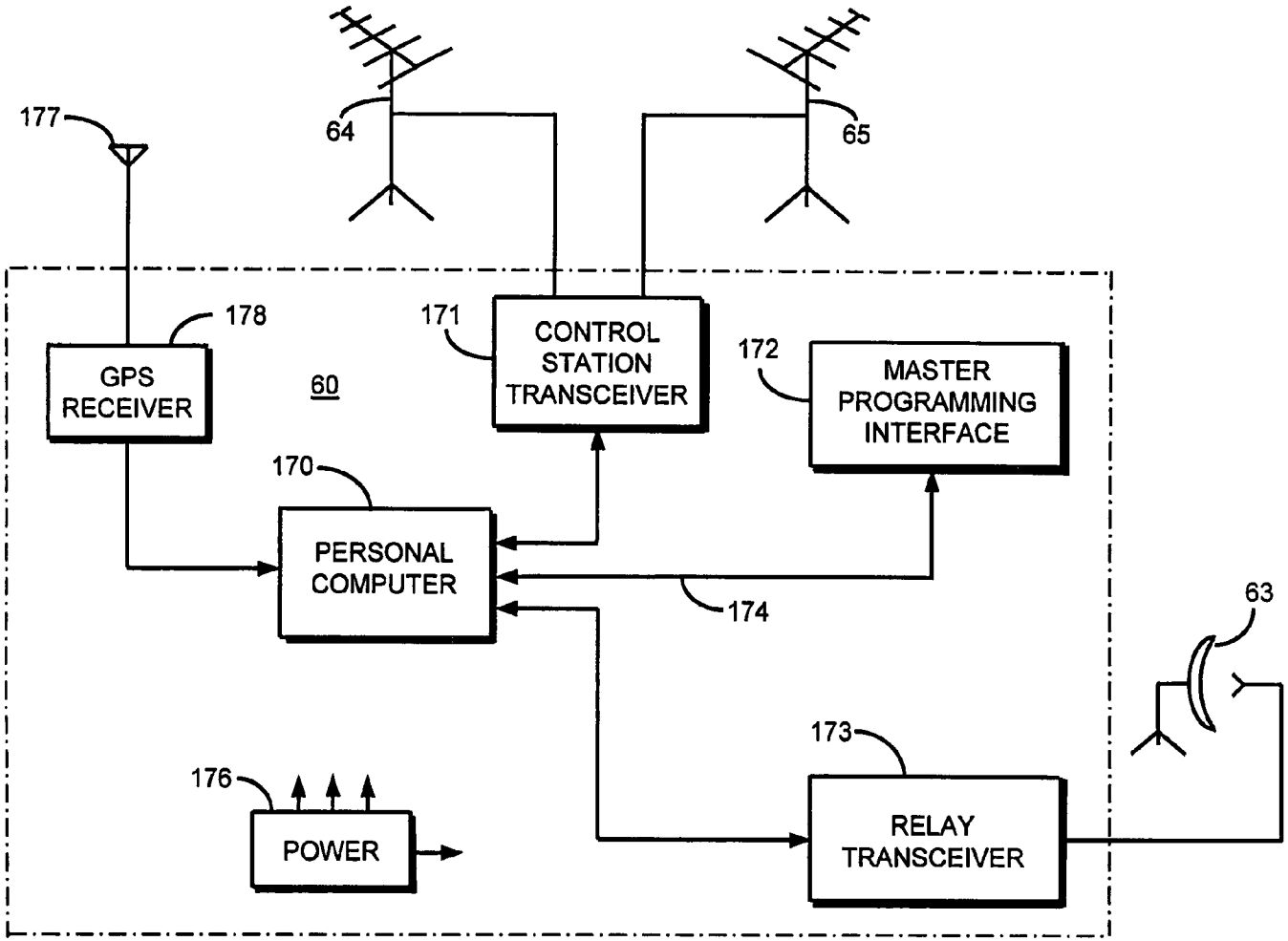
FIG. 10 is an exemplary block diagram of the control station 60 and associated components in accordance with the present invention.

FIG. 10 is an exemplary block diagram of the control station 60 and associated components in accordance with the present invention. The control station 60 comprises a personal computer 170, a control station transceiver 171, a master programming interface 172, a relay transceiver 173, a GPS receiver 178, a source of power 176, and various interfaces with antennas. The personal computer 170 is typically a laptop computer that includes the appropriate software to carry out all necessary functions to install and operate the FDT array 50. These functions include programming each FDT, controlling the operation of the array, commanding the initiation of transmit sequences, and making computations to determine the existence and movements of any intruder or intruders.

The control station transceiver 171 includes components for communication similar to those found in the FDT. These components are identified in FIG. 7 and the accompanying description, and thus are not shown in FIG. 10. Two antenna matching networks and band pass filters (Antenna Match/BPF) 110 provide optimum coupling between the antennas 64 and 65 and the single chip transceiver 108. The single chip transceiver 108, crystal 109 and a low power micro-controller 107, included in the control station transceiver 171, allow the control station to operate on the same channel as the FDTs in the array 50, and to generate, receive and decode the frequency shift keyed Manchester coded signals. The personal computer 170 generates commands following the pattern depicted in FIG. 6 and its description contained herein. The micro-controller 107 and single chip transceiver 108 encode these commands in the Manchester format and transmit the command messages to the appropriate FDT, typically FDT 1.

Two antennas 64 and 65 are shown; these are typically high gain, narrow beamwidth antennas aimed directly at the FDT with which communication is being carried out. In the array as depicted in FIG. 4, the separation between FDT1 and FDT99 is sufficiently great that two directional antennas may be required for successful communication. If the array is configured in such a manner that the distance between the control station 60 and both ends of the array is sufficiently small, then a single, less directional antenna can be used.

The information in received signals is extracted from the coded waveform by the micro-controller 107 (included within control station transceiver 171) and is supplied to the personal computer 170 for evaluation. Based on the history of signal strengths in various detection zones between selected FDTs, and preliminary intruder detections declared by individual FDTs, the personal computer may determine that an intrusion is taking place and generate estimates of the number of intruders, their location and their direction of travel and speed.

The master-programming interface 172 provides the means to program the FDTs, usually as they are installed in an array 50. The master-programming interface is an inductive transducer that is coupled to the personal computer 170 by a flexible cable 174 which allows the master-programming interface to be placed in close proximity to the programming interface 112 within the FDT. As an alternative to magnetic induction, the transducers may use low-power radio frequency signals to accomplish the transfer of information. The location of the programming interface in the FDT is identified by the program interface label 164 on the surface of the FDT housing. Existing data stored within the FDT's low power micro-controller 107 can be transferred out of the FDT to the personal computer 170 by way of this transducer-to-transducer interface. Information that can be transferred from the personal computer to the FDT's micro-controller 107 includes the values for constants $K_A$, $K_B$, $K_C$, the channel of operation, this FDT's unit number and time slot, etc.

Another subsystem that is a part of the control station is the relay transceiver 173; its purpose is to relay processed information from the control station to a remote control center 62 over the communication link 66. It also provides the means for the remote control center 62 to send information and commands to the control station 60 and thus to direct the operation of the array 50. The relay transceiver 173 includes the required interface to the personal computer, a means to encode messages, a transmitter, a receiver and an antenna coupling network to interface with antenna 63. Communication with the remote control center 62 may be by means of a microwave link, satellite link, land line, etc. This communication link 66 has a typical range capability of up to 50 miles.

Antenna 177 is coupled to the GPS receiver 178 that provides GPS positional data to the personal computer 170. This data may then be used in the deployment of the array 50, or transferred to individual FDTs as a part of their programming. The control station 60 includes a source of power 176 to provide the power needs of each of its subsystems. The power source includes rechargeable batteries sufficient to energize the control station for the length of time required to install an array, including the programming of each FDT. The power source also includes a battery charger that is capable of accepting normal 120 volt AC or 12 volt DC vehicle power.

Figure 11:
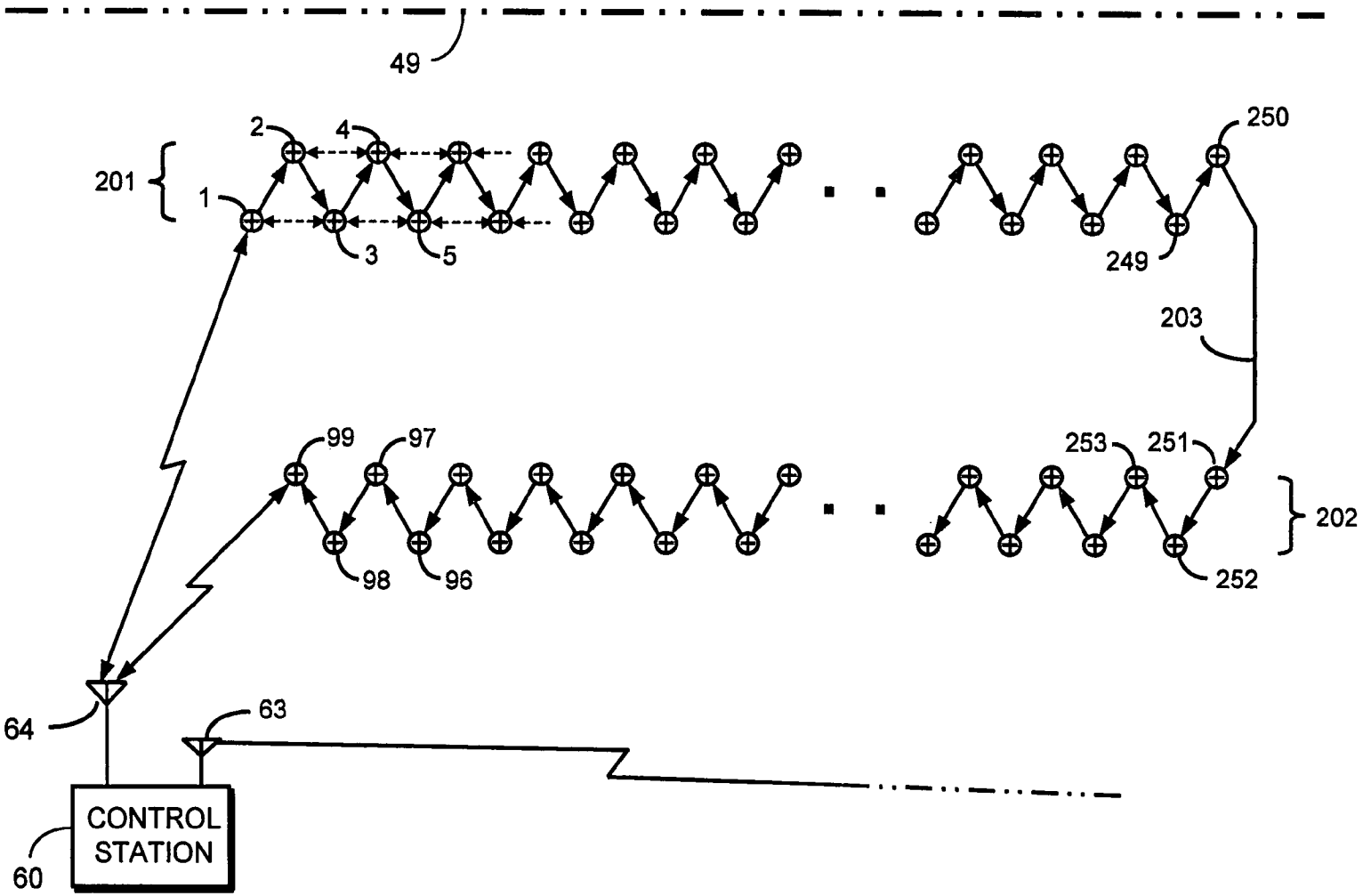
FIG. 11 is an exemplary depiction of a first alternate configuration for the deployment of the FDT array wherein the array is divided into two equal length sections with the sections spaced a distance apart and extending parallel to each other.

FIG. 11 is an exemplary depiction of a first alternate configuration for the deployment of the FDT array. Shown is an array of ninety-nine FDTs separated into two sections with section 201 including the first fifty FDTs and section 202 including FDTs fifty-one through ninety-nine. The array is not drawn to scale. Other than the division into two sections the physical layout and relationships of the FDTs to each other are the same as that provided in FIG. 4 and its description. Section 201 is positioned nearest to the boundary 49 to be protected. Section 202 is positioned parallel to section 201 with the distance between being typically 100 meters. The solid arrows shown in FIG. 11 show the sequential progression of the transmissions from each of the FDTs. When FDT fifty 250 transmitts in its proper time slot, its transmission is received by FDT fifty-one 251 via the propagation path 203. The transmission sequence then proceeds along section 202 until it concludes with the transmission of FDT 99. The control station 60 is the same as that depicted in FIG. 4, except that only one antenna 64 is needed to communicate with the FTDs since FDT 1 and FDT 99 are in close proximity to each other.

This first alternate configuration provides several desirable features for some installations of the array. As described above, the control station 60 can be placed near the positions of the first and last FDTs in the timing sequence and thus needs only a single antenna. An intruder will typically be detected first passing through section 201 and then at a slightly later time through section 202. Estimates of intruder speed and direction of travel may be deduced from the locations and timing of the detections. Animals that may be in the area will not typically travel through the array sequentially passing through one section and then the other in a short period of time. Thus, this array configuration provides a degree of ability to separate the detection of intruders of interest from indigenous animals.

Figure 12:
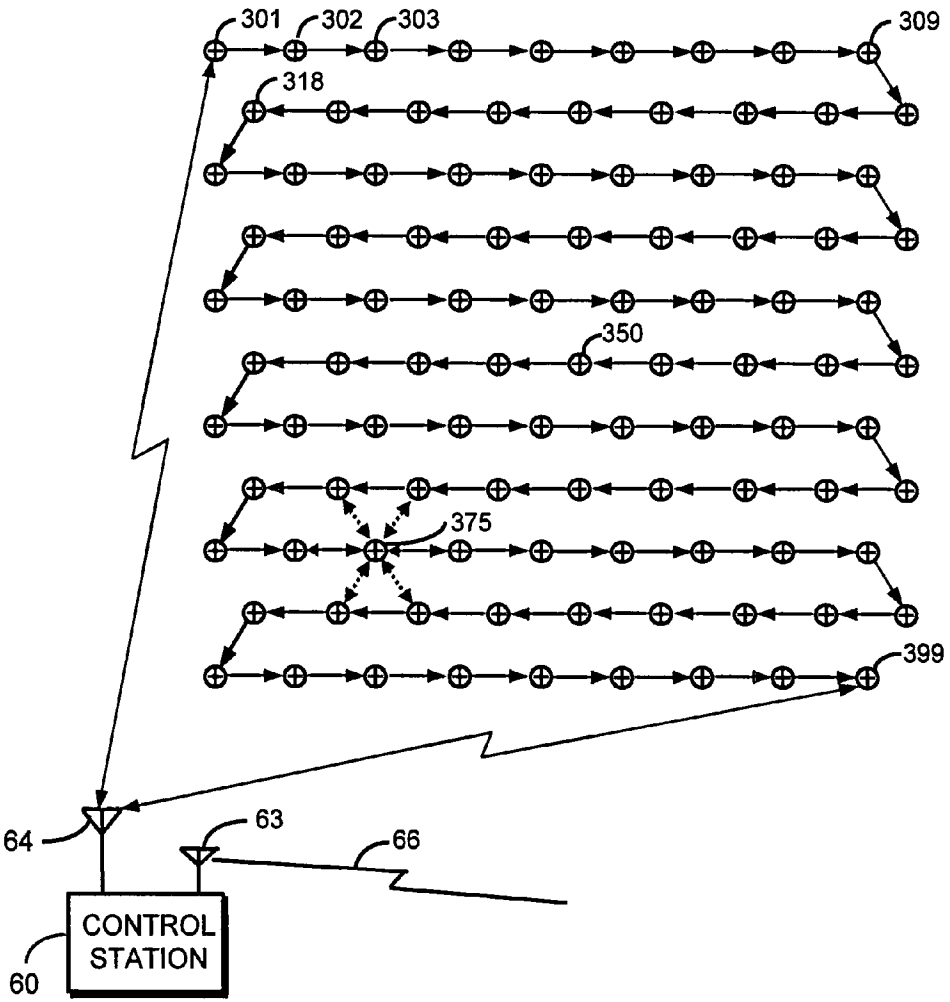
FIG. 12 is an exemplary depiction of a second alternate configuration for the deployment of the FDT array wherein the FDTs in the array are deployed in multiple rows thus forming an essentially square field of protection centered about a central object.

FIG. 12 is an exemplary depiction of a second alternate configuration for the deployment of the FDT array. In this configuration, the ninety-nine FDTs are distributed in eleven rows of nine FDTs each. The distances between FDTs and between rows are essentially constant throughout the array. Positioning of the FDTs is chosen so that the distance is approximately the same from an FDT to each of the six surrounding FDTs.

It can be seen that FDT 375 can form six disturbance zones between it and the nearest surrounding FDTs. The rows are typically spaced 30 meters (approximately 100 feet) apart, and the distance between FDTs in a row is approximately 37 meters (about 120 feet). The result is an array with overall dimensions of approximately 300 meters by 300 meters (about 1000×1000 feet). FDT 301 and FDT 399 communicate to the control station 60 in the same manner as for other array configurations by coupling to antenna 64. All other functions of the control station 60 remain the same.

This second alternate configuration of the array may be used to protect a highly valuable asset by locating the asset in near proximity to FDT 350. Any intruder approaching the asset will be detected numerous times by the multiplicity of FDTs that they will pass by. This configuration can also be deployed at a "choke point" that numerous intruders or other persons of interest must pass through due to terrain, man made structures, etc. The array will allow the development of statistical information about the number of intruders, and characteristics of their passage.

Figure 13:
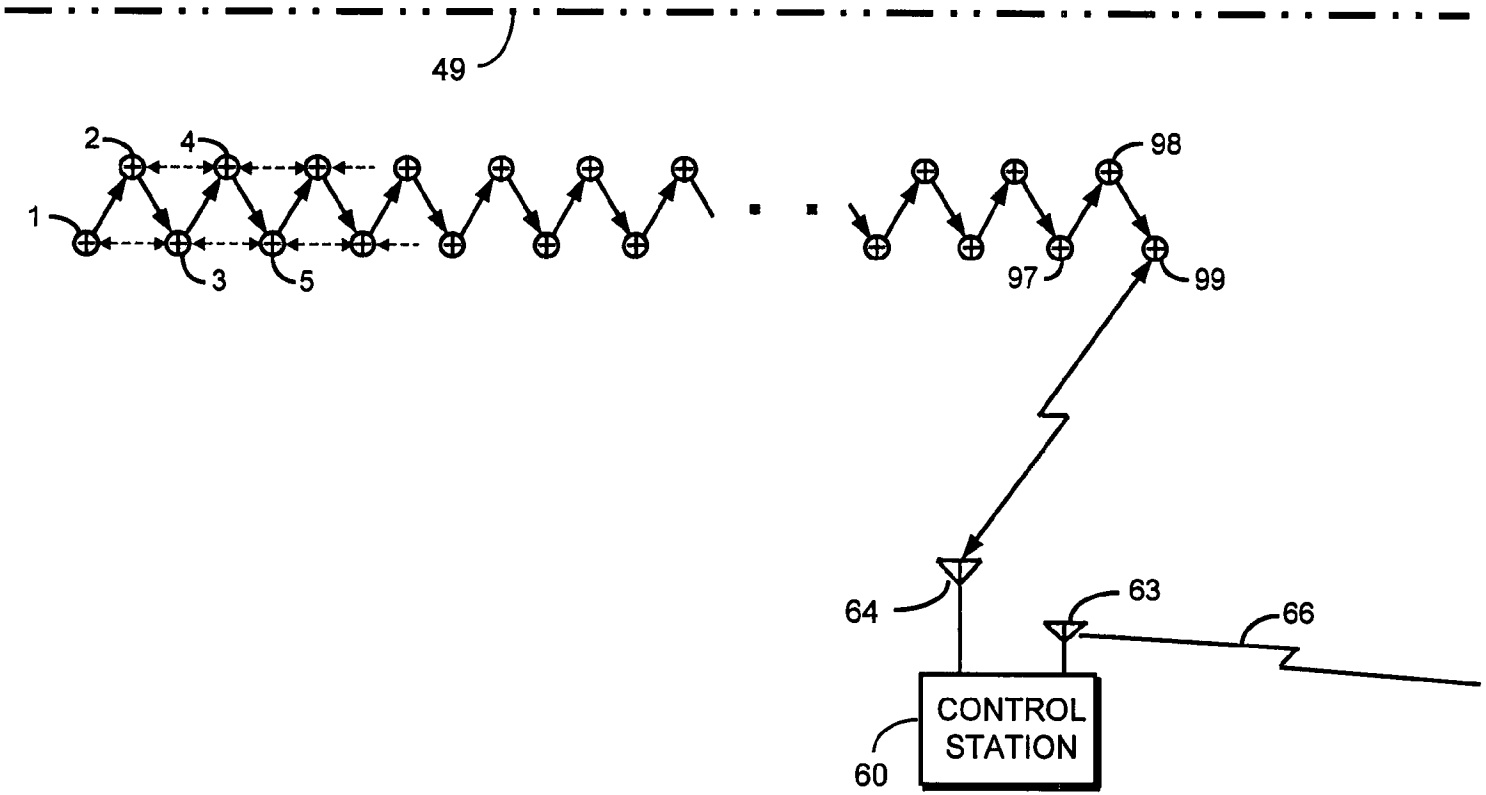
FIG. 13 is an exemplary depiction of a third alternate configuration for the deployment of the FDT array in which the control station is not required to directly communicate with the first FDT to initiate transmission.

FIG. 13 is an exemplary depiction of a third alternate configuration for the deployment of the FDT array 50. In this configuration, the placement of the FDTs is the same as that shown in FIG. 4, but the control station 60 has a different placement and a modification of its function. In this configuration, FDT 1 has the additional timing capability to transmit, without external command, in the FDT 1 time slot once each second, and thus to initiate the timing sequence for all other FDTs. In this configuration, the control station only requires a receive function and does not transmit to the array. The control station is positioned within receiving range of the last FDT in the array (FDT N in FIG. 5). Up to 100 FDTs can be accommodated. This configuration results in a simpler control station, but causes some loss of system flexibility and the ability to easily reprogram the array once installed.

We claim:

1. A method of sensing an intruder in a protected area, the protected area defined by an array of field disturbance units, the method comprising:

using a field disturbance unit to transmit a radio frequency signal, wherein the transmitted radio frequency signal is encoded with data;

receiving the transmitted radio frequency signal at a different field disturbance unit, wherein the received radio frequency signal has a received signal strength; and analyzing the received radio frequency signal at the different field disturbance unit to determine the presence of an intruder within the protected area defined by the array of field disturbance units, wherein the step of analyzing includes converting the received radio frequency signal into a digital signal having an amplitude that is proportional to the received signal strength of the received radio frequency signal and wherein the step of analyzing further includes (a) determining the average amplitude of received signals, wherein the step of determining the average amplitude of received signals includes: subtracting a detection zone average amplitude memory value from the digital signal thereby creating a first output value, dividing the first output value by a first constant thereby creating a first quotient value, and adding the first quotient value with the detection zone average amplitude memory value thereby creating a second output value, storing the second output value in the detection zone average amplitude memory thereby replacing a previous detection zone average amplitude memory value;

(b) determining the average variation of received signals, wherein the step of determining the average variation of received signals includes: taking the absolute value of the first output value thereby creating a positive value equivalent to the magnitude of the first output value; subtracting a detection zone average variation memory value from the absolute value of the first output value thereby creating a third output value, dividing the third output value by a second constant thereby creating a second quotient value, adding the second quotient value with the detection zone average variation memory value thereby creating a fourth output value, storing the fourth output value in the detection zone average variation memory thereby replacing a pervious detection zone average variation memory value; and (c) determining the presence of an intruder, the step including: multiplying the detection zone average variation memory value with a third constant thereby creating a first product, summing the first product with a minimum threshold value, thereby creating a fifth output value, comparing the fifth output value to the absolute value of the first output value to determine the presence of an intruder by presenting the fifth output value to the negative terminal of a comparator and presenting the absolute value of the first output value to the positive terminal of the comparator, wherein the comparator producing a positive value indicates the presence of an intruder.

2. The method of claim 1, wherein the transmitted radio frequency signal has a signal strength of approximately one milliWatt.

3. The method of claim 1, wherein each field disturbance unit in the array has a transmission time slot unique to each field disturbance unit, wherein each field disturbance unit transmits during its unique transmission time slot, and wherein each field disturbance unit transmits once during a sampling period, and wherein only one field disturbance unit in the array transmits at a time.

4. The method of claim 3, wherein each field disturbance unit transmits for approximately 8.3 milliseconds, and wherein the sampling period is 1.0 seconds.

5. The method of claim 3, wherein the different field disturbance unit receives the transmitted radio frequency signal from transmitting field disturbance units up to two unique transmission time slots before the unique transmission time slot of the different field disturbance unit and up to two unique transmission time slots after the unique transmission time slot of the different field disturbance unit.

6. The method of claim 3, further comprising:

transmitting from at least one of the field disturbance units, a final radio frequency signal for the sampling period, the final radio frequency signal encoded with accumulated data pertaining to the status of the protected area, receiving the final radio frequency signal at a control station;

analyzing, at the control station, the final radio frequency signal, wherein the step of analyzing the final radio frequency signal includes determining a presence of one or more intruders within the protected area, determining a quantity of one or more intruders within the protected area, determining a location of one or more intruders within the protected area, determining a direction of travel for one or more intruders within the protected area, and determining a speed for one or more intruders within the protected area; and communicating commands to the at least one field disturbance units in the array, from the control station.

7. The method of claim 6, further comprising:

communicating, from the control station, to a remote control center, wherein the step of communicating to a remote control center includes communicating the presence of one or more intruders within the protected area.

8. The method of claim 6, wherein the transmitted radio frequency signal and the final radio frequency signal have a frequency from about 902 MHz to about 928 MHz.

9. A method of sensing an intruder in a protected area, the protected area defined by an array of field disturbance units, the method comprising:

using a field disturbance unit to transmit a radio frequency signal, wherein the transmitted radio frequency signal is encoded with data;

receiving the transmitted radio frequency signal at a different field disturbance unit, wherein the received radio frequency signal has a received signal strength; and analyzing the received radio frequency signal at the different field disturbance unit to determine the presence of an intruder within the protected area defined by the array of field disturbance units, wherein each field disturbance unit in the array has a transmission time slot unique to each field disturbance unit, wherein each field disturbance unit transmits during its unique transmission time slot, and wherein each field disturbance unit transmits once during a sampling period, wherein only one field disturbance unit in the array transmits at a time, and wherein the different field disturbance unit receives the transmitted radio frequency signal from transmitting field disturbance units up to two unique transmission time slots before the unique transmission time slot of the different field disturbance unit and up to two unique transmission time slots after the unique transmission time slot of the different field disturbance unit.

10. The method of claim 9, wherein the transmitted radio frequency signal has a signal strength of approximately one milliWatt.

11. The method of claim 9, wherein each field disturbance unit transmits for approximately 8.3 milliseconds, and wherein the sampling period is 1.0 seconds.

12. The method of claim 9, further comprising:

transmitting from at least one of the field disturbance units, a final radio frequency signal for the sampling period, the final radio frequency signal encoded with accumulated data pertaining to the status of the protected area, receiving the final radio frequency signal at a control station;

analyzing, at the control station, the final radio frequency signal, wherein the step of analyzing the final radio frequency signal includes determining a presence of one or more intruders within the protected area, determining a quantity of one or more intruders within the protected area, determining a location of one or more intruders within the protected area, determining a direction of travel for one or more intruders within the protected area, and determining a speed for one or more intruders within the protected area; and communicating commands to the at least one field disturbance units in the array, from the control station.

13. The method of claim 12, further comprising:

communicating, from the control station, to a remote control center, wherein the step of communicating to a remote control center includes communicating the presence of one or more intruders within the protected area.

14. The method of claim 12, wherein the transmitted radio frequency signal and the final radio frequency signal have a frequency from about 902 MHz to about 928 MHz.

15. The method of claim 9, wherein the step of analyzing includes converting the received radio frequency signal into a digital signal having an amplitude that is proportional to the received signal strength of the received radio frequency signal.

16. The method of claim 15, further comprising:

(a) determining the average amplitude of received signals, wherein the step of determining the average amplitude of received signals includes: subtracting a detection zone average amplitude memory value from the digital signal thereby creating a first output value, dividing the first output value by a first constant thereby creating a first quotient value, and adding the first quotient value with the detection zone average amplitude memory value thereby creating a second output value, storing the second output value in the detection zone average amplitude memory thereby replacing a previous detection zone average amplitude memory value;

(b) determining the average variation of received signals, wherein the step of determining the average variation of received signals includes: taking the absolute value of the first output value thereby creating a positive value equivalent to the magnitude of the first output value; subtracting a detection zone average variation memory value from the absolute value of the first output value thereby creating a third output value, dividing the third output value by a second constant thereby creating a second quotient value, adding the second quotient value with the detection zone average variation memory value thereby creating a fourth output value, storing the fourth output value in the detection zone average variation memory thereby replacing a pervious detection zone average variation memory value; and (c) determining the presence of an intruder, the step including: multiplying the detection zone average variation memory value with a third constant thereby creating a first product, summing the first product with a minimum threshold value, thereby creating a fifth output value, comparing the fifth output value to the absolute value of the first output value to determine the presence of an intruder by presenting the fifth output value to the negative terminal of a comparator and presenting the absolute value of the first output value to the positive terminal of the comparator, wherein the comparator producing a positive value indicates the presence of an intruder.

* * * * *